US006820575B2

(12) United States Patent
Ashton, III et al.

(10) Patent No.: US 6,820,575 B2
(45) Date of Patent: Nov. 23, 2004

(54) UPPER BUNDLE STEAM GENERATOR CLEANING, INSPECTION, AND REPAIR SYSTEM

(75) Inventors: Augustus J. Ashton, III, Westboro, MA (US); J. Timothy Lovett, Wellesley, MA (US); Daniel Fischbach, N. Chelmsford, MA (US); Steven K. Ruggieri, Marlborough, MA (US); Alan Brightman, Bridgewater, MA (US); Steven Jens, Winchester, MA (US)

(73) Assignee: Foster-Miller, Inc., Waltham, MA (US)

( * ) Notice: Subject to any disclaimer, the term of this patent is extended or adjusted under 35 U.S.C. 154(b) by 0 days.

(21) Appl. No.: 10/676,556

(22) Filed: Oct. 1, 2003

(65) Prior Publication Data

US 2004/0083986 A1 May 6, 2004

Related U.S. Application Data

(63) Continuation of application No. 09/616,481, filed on Jul. 14, 2000, now Pat. No. 6,672,257, which is a continuation of application No. 08/728,905, filed on Oct. 11, 1996, now abandoned, which is a continuation-in-part of application No. 08/239,378, filed on May 6, 1994, now Pat. No. 5,564,371.

(51) Int. Cl.[7] ..... F22B 37/18

(52) U.S. Cl. ..... 122/379; 390/392

(58) Field of Search ..... 122/379, 390, 122/392; 165/11.2, 95; 134/167 R, 181; 376/245, 248, 249, 310, 316

(56) References Cited

U.S. PATENT DOCUMENTS

| | | |
|---|---|---|
| 338,310 A | 3/1886 | Smith |
| 1,905,824 A | 4/1933 | Dysthe |
| 3,120,237 A | 2/1964 | Lang |

FOREIGN PATENT DOCUMENTS

| | | |
|---|---|---|
| DE | 3044788 A1 | 7/1982 |
| DE | 4226854 A | 2/1994 |
| JP | 53-21303 | 2/1978 |
| JP | 58-132339 | 9/1983 |
| JP | 58-224218 | 12/1983 |
| JP | 59-500065 | 1/1984 |
| JP | 61-130798 | 6/1986 |
| JP | 61-130799 | 6/1986 |
| JP | 62-33299 | 2/1987 |
| JP | 62-45535 | 3/1987 |
| JP | 62-74730 | 4/1987 |
| JP | 62-87720 | 4/1987 |
| JP | 62-241692 | 10/1987 |
| JP | 63-93587 | 4/1988 |
| JP | 63-182394 | 7/1988 |
| JP | 64-31394 | 2/1989 |
| JP | 5-52592 | 3/1993 |
| JP | 6-201085 | 7/1994 |
| JP | 6-274730 | 9/1994 |
| JP | 6-320473 | 11/1994 |
| JP | 09-026107 | 1/1997 |
| WO | WO 90/09850 | 9/1990 |
| WO | WO 96/17695 | 6/1996 |

(List continued on next page.)

*Primary Examiner*—Jiping Lu
(74) *Attorney, Agent, or Firm*—Iandiorio & Teska

(57) ABSTRACT

An upper bundle steam generator cleaning, inspection, and repair system includes a deployment and support device receivable within the steam generator configured to raise and position a distal end of said device to the upper bundle region of the steam generator, a head subsystem connected to the distal end of the deployment and support device for at least one of cleaning, inspection, and repair of said upper bundle region, and a lateral support subsystem deployable to support said head subsystem within the upper bundle region of the steam generator and retractable to deploy said head subsystem up to the upper bundle region and to withdraw said head subsystem therefrom.

26 Claims, 25 Drawing Sheets

U.S. PATENT DOCUMENTS 3,330,105 A 7/1967 Weber
3,599,871 A 8/1971 Ruppel et al.
3,655,122 A 4/1972 Brown et al.
4,107,001 A 8/1978 Kinzler
4,219,976 A 9/1980 Burack et al.
4,231,419 A 11/1980 Gugel
4,384,594 A 5/1983 Moritz
4,392,344 A 7/1983 Gordon et al.
4,424,769 A 1/1984 Charamathieu et al.
4,478,546 A 10/1984 Mercer
4,498,427 A 2/1985 Todd
4,572,284 A 2/1986 Katscher et al.
4,637,588 A 1/1987 Wilhelm et al.
4,638,667 A 1/1987 Zimmer et al.
4,656,714 A 4/1987 Evans et al.
4,667,701 A 5/1987 Evans et al.
4,671,326 A 6/1987 Wilhelm et al.
4,676,201 A 6/1987 Lahoda et al.
4,682,630 A 7/1987 Schukei
4,690,172 A 9/1987 Everett
4,691,723 A 9/1987 Mierswa et al.
4,700,662 A 10/1987 Fashacht, Jr. et al.
4,702,281 A 10/1987 Moritz
4,723,881 A 2/1988 Duran
4,729,423 A 3/1988 Martin
4,744,392 A 5/1988 Tade, III et al.
4,769,085 A 9/1988 Booij
4,770,235 A 9/1988 Rogers, Jr. et al.
4,826,036 A 5/1989 Lewis et al.
4,827,953 A 5/1989 Lee
4,834,069 A 5/1989 Umeda
4,844,021 A 7/1989 Stoss
4,860,919 A 8/1989 Weisel et al.
4,887,555 A 12/1989 Smet
4,932,441 A 6/1990 Corey et al.
4,954,312 A 9/1990 McDonald et al.
4,957,215 A 9/1990 Evans et al.
4,959,192 A 9/1990 Trundle et al.
4,980,120 A 12/1990 Bowman et al.
4,989,818 A 2/1991 Trundle et al.
5,006,302 A 4/1991 Trundle et al.
5,007,460 A 4/1991 Zezza et al.
5,032,048 A 7/1991 Walton et al.
5,032,350 A 7/1991 McDonald et al.
5,036,871 A 8/1991 Ruggieri et al.
5,042,861 A 8/1991 Trundle et al.
5,048,570 A 9/1991 Weisel et al.
5,065,703 A 11/1991 Lee
5,135,330 A 8/1992 Chen
5,164,151 A 11/1992 Shah et al.
H1115 H 12/1992 Nachbar
5,167,905 A 12/1992 Mentz et al.
5,169,594 A 12/1992 Tade, III et al.
5,171,514 A 12/1992 Veronesi et al.
5,172,653 A 12/1992 Vadakin
5,178,129 A 1/1993 Chikama et al.
5,178,820 A * 1/1993 Glass et al. ..... 376/260
5,184,636 A 2/1993 Van Der Woude
5,194,217 A 3/1993 St Louis et al.
5,205,693 A 4/1993 Fuller et al.
5,238,054 A 8/1993 Ritz et al.
5,261,600 A 11/1993 Cradeur
5,265,129 A * 11/1993 Brooks et al. ..... 376/248
5,286,154 A 2/1994 Jens et al.
5,292,074 A 3/1994 Clark et al.
5,305,713 A 4/1994 Vadakin
5,341,406 A 8/1994 Jens et al.
5,348,234 A 9/1994 Van der Woude
5,411,043 A 5/1995 Kamler
5,504,788 A * 4/1996 Brooks et al. ..... 376/248
5,564,371 A * 10/1996 Ashton et al. ..... 122/392
5,570,660 A 11/1996 Vandenberg
5,615,734 A 4/1997 Hyp
5,638,415 A 6/1997 Nafziger et al.
5,782,209 A 7/1998 Vandenberg
5,913,320 A * 6/1999 Varrin et al. ..... 134/22.18
6,543,392 B1 * 4/2003 Ashton et al. ..... 122/392
6,672,257 B1 * 1/2004 Ashton et al. ..... 122/379

* cited by examiner

UPPER BUNDLE STEAM GENERATOR CLEANING, INSPECTION, AND REPAIR SYSTEM

RELATED APPLICATIONS

This application is a Continuation of U.S. application Ser. No. 09/616,481 filed Jul. 14, 2000 now U.S. Pat. No. 6,672,257, which is a Continuation of U.S. application Ser. No. 08/728,905 filed Oct. 11, 1996 now abandoned, which is a Continuation-in-Part of U.S. application Ser. No. 08/239,378 filed May 6, 1994 (U.S. Pat. No. 5,564,371) for which a reissue application was filed Oct. 15, 1998, application Ser. No. 09/173,570. This application is also related to U.S. application Ser. No. 08/682,645 which was changed by the U.S. patent Office to Ser. No. 08/379,646 which is a Continuation-in-Part of application Ser. No. 08/839,378.

FIELD OF THE INVENTION

This invention relates to an upper bundle cleaning, inspection, and repair system for a nuclear power plant steam generator.

BACKGROUND OF THE INVENTION

Steam generators convert heat from the primary side of a nuclear power plant to steam on the secondary side so that the primary and secondary systems are kept separate. A typical generator is a vertical cylinder consisting of a large number of U-shaped tubes which extend from the floor or "tube sheet" of the generator. High temperature and pressure fluid from the reactor travels through the tubes giving up energy to a feedwater blanket surrounding the tubes in the generator creating steam and ultimately power when later introduced to turbines.

Steam generators were designed to last upwards of forty years but in practice such reliability figures have proven not to be the case. The problem is that sludge from particulate impurities suspended in the feed-water forms on the tubes which greatly affects the efficiency of the generator and can even cause the tubes to degrade to the point of causing fissures in the tubes. If radioactive primary fluid within the tubes seeps into the secondary side, the result can be disastrous. Plugging or otherwise servicing such fissures is time consuming and results in expensive down time during which power must be purchased from other sources at a great expense.

There are known methods for cleaning the tubes proximate the bottom of the steam generator using flexible lances and the like which clean the tubes using water under pressure, but since a typical steam generator can be thirty feet tall, it is difficult to reach the sludge at the upper levels of the tubes using water jets. So, chemical cleaning is used but there are several disadvantages. First, chemical cleaning is very expensive (from $5,000,000 to $10,000,000 per application) and requires an extended outage. Also, some corrosion of steam generator internals by the solvents used will occur during the cleaning. In addition, large quantities of hazardous, possibly radioactive waste may be generated. Disposal of this waste is very expensive. For these reasons, although many utilities have considered chemical cleaning, few plants have actually implemented chemical cleaning.

On the other hand, there are severe technical challenges faced when considering alternate cleaning methods. A typical steam generator has approximately 50,000 square feet of heat transfer area. The tube bundle is about 10 feet in diameter and 30 feet tall but the access alley in the middle of the tube bundle is only 3.5 inches wide and is interrupted by support plates approximately every 4 feet. There are flow slots through the support plates but they are very small in size, typically 2.75 by 15 inches. In addition, the access into the steam generator is limited to a six inch hand hole. Finally, inter tube gaps are only 0.406 wide or smaller.

Thus, the inherent design parameters of a typical steam generator make it difficult to incorporate water jet sludge lancing techniques at the upper tube bundles even though these techniques are adequate to clean the tubes at the level of the tube sheet at the bottom most portion of the steam generator. See, e.g. U.S. Pat. Nos. 4,700,662; 4,980,120; 4,887,555; 4,676,201; and 4,769,085. Furthermore, the crowded interior space of a steam generator makes it very difficult to inspect and/or repair the individual tubes near the upper regions of the steam generator.

SUMMARY OF THE INVENTION

It is therefore an object of this invention to provide an upper bundle steam generator cleaning, inspection, and repair system.

It is a further object of this invention to provide such an upper bundle steam generator cleaning, inspection, and repair system which facilitates cleaning the generator from the top down thereby flushing deposits downward during the cleaning process.

It is a further object of this invention to provide such an upper bundle steam generator cleaning, inspection, and repair system which eliminates the need to use chemical cleaning techniques and overcomes the disadvantages inherent in chemical cleaning or which can be used in conjunction with chemical cleaning.

It is a further object of this invention to provide such an upper bundle steam generator cleaning, inspection, and repair system which adequately cleans the upper bundles of the steam generator using water under pressure even within the close confines of the tubes of the steam generator.

It is a further object of this invention to provide such an upper bundle steam generator cleaning, inspection, and repair system which successfully delivers sufficient water energy to remove scale and also distributes this energy in an efficient manner throughout the tube bundle.

It is a further object of this invention to provide such an upper bundle steam generator cleaning, inspection, and repair system which accomplishes cleaning remotely thereby overcoming the access restrictions of the steam generator as well as reducing exposure of personnel to radiation.

It is a further object of this invention to provide such an upper bundle steam generator cleaning, inspection, and repair system which maximizes cleaning effectiveness with a minimum use of water.

It is a further object of this invention to provide such an upper bundle steam generator cleaning, inspection, and repair system which minimizes the number of equipment moves during the cleaning, inspection, and repair procedure thereby reducing cleaning and hence outage time.

It is a further object of this invention to provide such an upper bundle steam generator cleaning, inspection, and repair system which utilizes both a bulk cleaning, inspection, and repair head and a rigid lance for intertube inspection, cleaning, and repair.

It is a further object of this invention to provide such a system which has the capability to deliver inspection cameras; and drills, grippers, and welding or cutting devices and other tools even to the upper confines of the steam generator.

The invention results from the realization that even the upper bundles of a steam generator can be reliably inspected, cleaned, and repaired by deploying a telescoping or flexible arm up through the flow slots of the support plates of the steam generator; rotating the arm into place between the steam generator tubes; and deploying a tool such as a drill, grippers, or a welding or cutting device; providing number of cleaning nozzles; and/or a video camera and/or delivery and installing repair materials such as bars, brackets, or clamps to the individual tubes to be inspected, cleaned, or repaired.

This invention features an upper bundle steam generator cleaning, inspection, and repair system. There is a deployment and support device receivable within the steam generator including some means to raise and position a distal end of the device up to the upper bundles of the steam generator. There is a rotatable mechanism attached to the end of the deployment and support device and an arm attached to the rotatable mechanism. A cleaning device such as nozzles, an inspection device such as a camera, and/or one or more tools are attached to the other end of the arm.

In one embodiment, the deployment and support device includes a first boom coupled by a rotatable connector to a second boom, the first and second boom and the rotatable connector being insertable into an access port of the steam generator and into a lane separating two rows of tube members so that the second boom falls within the lane.

The rotatable mechanism preferably rotates the arm both horizontally and vertically within the steam generator. In one embodiment, the arm includes a set of telescoping members; and in another embodiment the arm is made of a flexible material. Alternatively, only the distal end of the arm may be made of the flexible material.

In another embodiment, the deployment and support device includes an elongated body feedable through an access in the steam generator shell proximate the tube sheet of the steam generator. The elongated body is flexible in one configuration to bend into position for extension up to the flow slots in the support plates of the interior of the steam generator, and yet rigid in another configuration for positioning and supporting cleaning, inspection, or tool devices up through the steam generator proximate the upper tube bundles of the steam generator. There is also some means for driving the elongated body up through the support plates and for retracting the elongated body back down through the support plates.

The elongated body may be a rigid chain, a pair of rigid chains, a number of bendable links, a number of rigid links, or a material self-biased to form a tube.

DISCLOSURE OF THE PREFERRED EMBODIMENT

Other objects, features and advantages will occur to those skilled in the art from the following description of a preferred embodiment and the accompanying drawings, in which.

Figure 1:
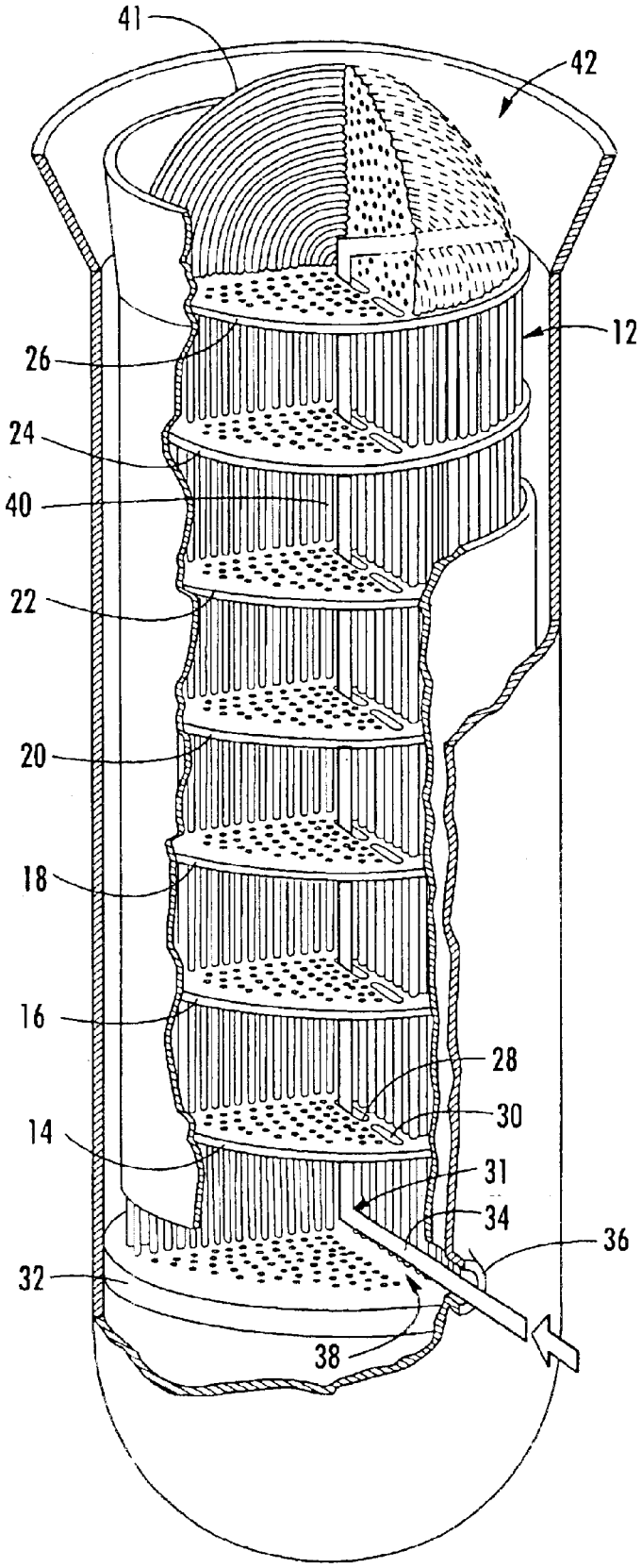
FIG. 1 is a schematic, partially cut away view of a typical steam generator of a nuclear power plant.

FIG. 1 schematically shows steam generator 10 which includes heat transfer tubes 12 separated into sections by tube support plates 14, 16, 18, 20, 22, 24 and 26. Each tube support plate includes a number of flow slots 28 and 30 as shown for first tube support plate 14.

The Westinghouse model W44 and W51 steam generators comprise the largest steam generator market segment and the dimensions of the W51 are similar to the W44. The W44 steam generator utilizes 116" diameter tube support plates spaced evenly at 51" above the tube sheet. There are two 6" diameter hand holes such as hand hole 36 at each end of the 3½" blow down lane 38 at the tube sheet 32 level. Each tube sheet support plate has three flow slots measuring 2–2¾ by 15" spaced at 4" inches on each side of the center tie rod 40. The flow slots are aligned with respect to each other so that there is a clear "line of sight" vertical passage from the blow down lane 38 to the U-bends 41 of the tubes above the top tube support plate 26.

As discussed in the Background of the Invention above, there are known instruments for water-spray cleaning the areas between tube sheet 32 and first tube sheet support plate 14 at the bottom of the steam generator but the very close confines within the upper bundles of the steam generator make cleaning the tubes near the upper support plates 16–26 very difficult. See, e.g., U.S. Pat. No. 5,265,129.

In this invention, it was realized that there is an access path 34 from hand hole 36 along blow down lane 38 to the center tie rod 40 and then upwards through the aligned flow slots 28, 30, etc. in each support plate to the top portion 42 of the steam generator. And, it was realized that if a cleaning head or heads could be deployed to the top portion 42 of the steam generator, the generator could be cleaned from the top down thereby flushing deposits downward during the cleaning process. The technical challenge is to design cleaning heads which will fit within the close confines of the interior of the steam generator, to design cleaning heads which will still deliver water under sufficient pressure to thoroughly clean the tubes, and to design cleaning heads which will not become jammed inside the steam generator.

The upper bundle steam generator cleaning system of this invention, wherein an "upper bundle" is defined as those tubes within the steam generator above the first tube support plate 14, includes four main subsystems or components: (a) the cleaning head deployment and support device shown in FIG. 2; (b) a bulk cleaning head affixable to the support/deployment device which directs fluid in between the tubes from the flow slots and includes means to change the pitch of the spray and to clean the tubes proximate an adjacent flow slot at the same level as shown in FIGS. 3–7; (c) a rigid lance also affixable to the support/deployment subsystem which extends in between the tubes and directs fluid from between the tubes as shown in FIGS. 7–10 and (d) a support mechanism which releasably fixes and supports either type of cleaning head in place during spraying and also conveniently prevents equipment jams which could severely affect the cleaning process and cause down time. Each subsystem is discussed in turn.

The Deployment/Support Subsystem

Figure 2:
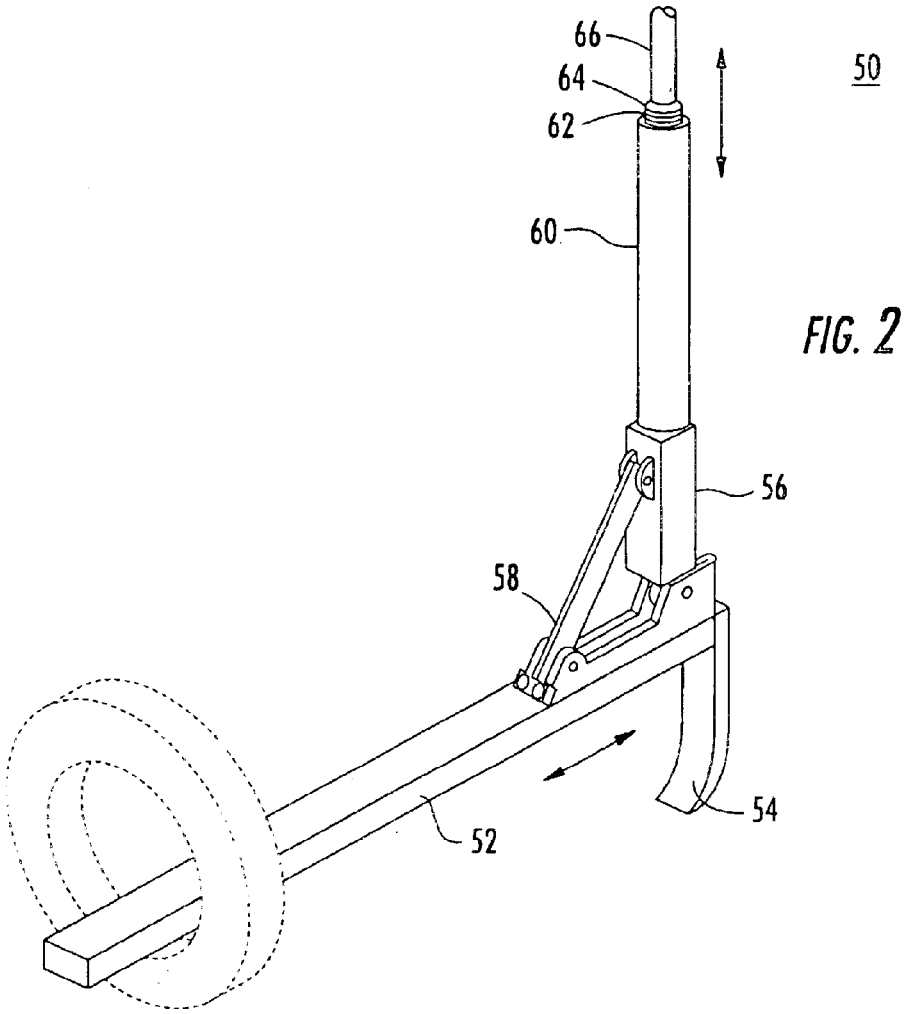
FIG. 2 is a schematic view of the deployment subsystem used to deploy and support various cleaning heads at different levels within the steam generator shown in FIG. 1.

The deployment subsystem 50, FIG. 2, includes translation rail 52, rail support 54, rotation stage 56, translation cart 58, and vertical position subsystem 60, including hydraulic cylinders 62, 64, 66. Deployment subsystem 50 is the mechanism used to deploy a spray head vertically within the steam generator to the elevation of the tube support plate to be accessed. Vertical positioning subsystem 60 is mounted at the top of rotation stage 56 which in turn rides on translation cart 58. Using motive means located outside the steam generator, the cart is caused to move down the blow down lane on rail 52 that is deployed through the hand hole.

This design is adapted from an existing design called the "Secondary Inspection Device (SID)" available from R. Brooks Associates of 6546 Pound Road, Williamson, N.Y., 14589 (see U.S. Pat. No. 5,265,129) and is a nine stage pneumatic cylinder currently used to transport a video camera up the blow down lane of a steam generator. Consequently, it is sized appropriately to pass through the hand hole and the flow slots of the steam generator. In its normal configuration, however, the secondary inspection device has several major shortcomings. The first of these is lack of control. The current control procedure is to increase cylinder air pressure to extend and reduce pressure to either retract or cease extending. Since the interstage seals permit significant leakage, it is frequently difficult to achieve a stable position. Also, since interstage friction plays a role in establishing an equilibrium position, anything which changes interstage friction, such as vibration, will cause the system to seek a new equilibrium position.

The other major short coming is an inadequate pay load capability. As a result of interstage seal leakage and small passages through the pressure regulator and supply hose, actual cylinder pressure can never be made to approach the pressure of the air supply and pay load is limited to about 5 pounds. Accordingly, this payload capability must be improved by a factor of 5–10 to support the cleaning heads of this invention.

A modification is made to incorporate cables inside the cylinders and a cable reel to control payout and takeup. Pressure inside the cylinders is maintained at a constant value, high enough to produce extension but held in check by the cable. Paying out the tension cable permits extension and taking up cable produces retraction. Cylinder pressure relief is provided for the retraction step. The cable reel is equipped with an encoder which would supply vertical position information. To improve the payload, internal pressure is increased, and cylinder weight decreased or both. Interstage seals are improved to greatly reduce leakage and pressurization is provided by water rather than air. Using water as a pressurization medium, internal pressures are several hundred psi are possible without creating an explosion hazard as would be the case with a compressible medium. Also, fabricating the cylinders from aluminum rather than steel reduces by about ⅔ the weight of the cylinders themselves. The control system is further discussed with reference to FIG. 14.

The Bulk Cleaning Head Subsystem

Figure 3:
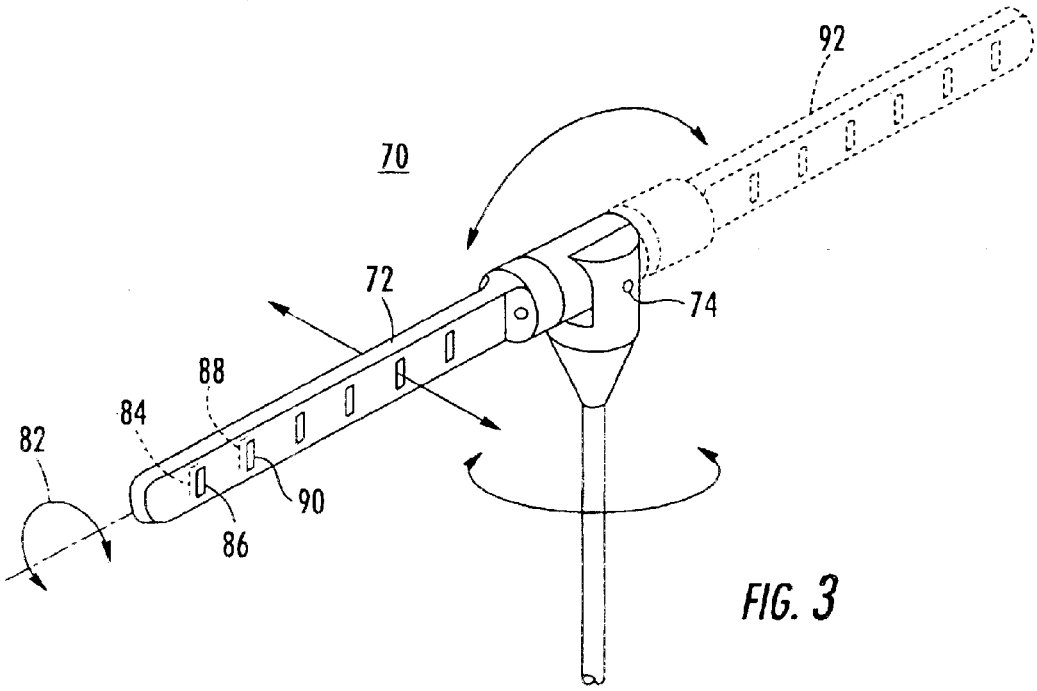
FIG. 3 is a schematic view of the bulk cleaning head subsystem of this invention used to direct water from the flow slots of the tube support plates of the steam generator.
Figure 4:
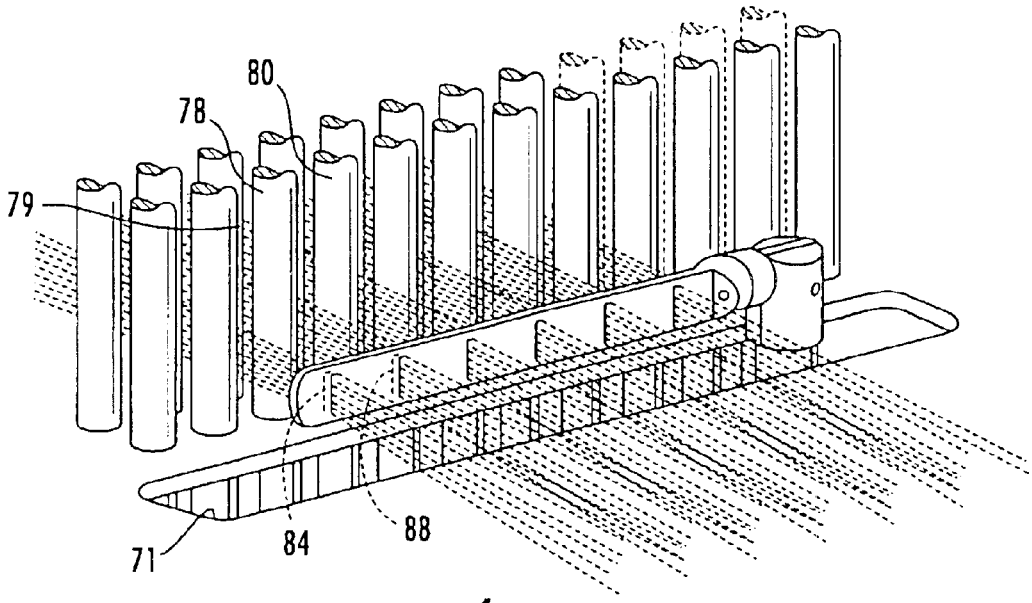
FIG. 4 is a schematic view of the bulk cleaning head subsystem of FIG. 3 shown in place within a flow slot directing water between rows of tubes.

Bulk cleaning head subsystem 70, FIG. 3, is mounted on top cylinder 66 of deployment/support subsystem 50, FIG. 2, and includes arm 72 extending from pivot support 74. The bulk cleaning head subsystem of this invention shown in FIG. 3 directs fluid in between the tubes from the flow slot. Bulk cleaning subsystem 70 extends along a flow slot such as flow slot 71, FIG. 4, and directs fluid in between the tubes 78, 80 from flow slot 71. Arm 72, FIG. 3, also rotates in the direction shown by arrow 82 to change the pitch orientation of the opposing nozzles 84, 86, 88, and 90 to clean the length of the tubes in between two support plates and also the surfaces of the support plates. Nozzles 84, 88 oppose nozzles 86, 90 as shown in order to effect cleaning of the tubes on both sides of flow slot 71 and also to balance the thrust received by arm 72 due to the high pressure water delivered by the nozzles. Nozzles 86 and 90 are spaced appropriately to align with the spaces in between tubes 78, 80, FIG. 4.

Arm 70 also swings over to the position shown in relief at 92 to clean the tubes proximate an adjacent flow slot without having to retract the cleaning head and deploy it up through the adjacent flow slot.

Figure 5A:
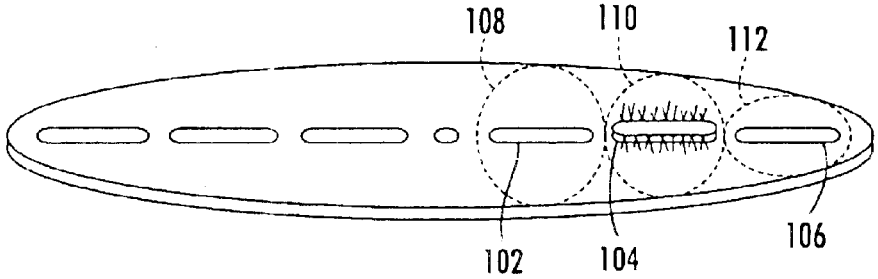
FIGS. 5A–5C are top plan views of the methodology of cleaning the various sectors of one level of a typical steam generator using the bulk cleaning head system shown in FIGS. 3–4.
Figure 5B:
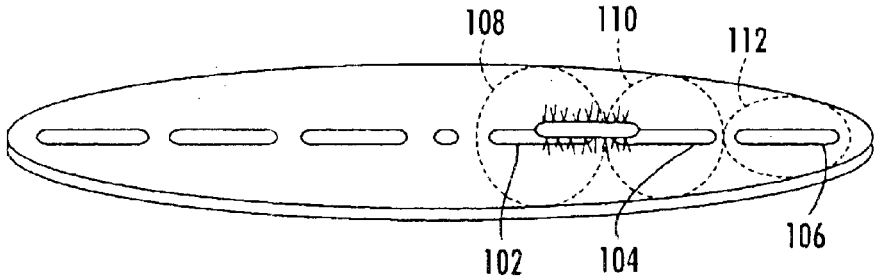
Figure 5C:
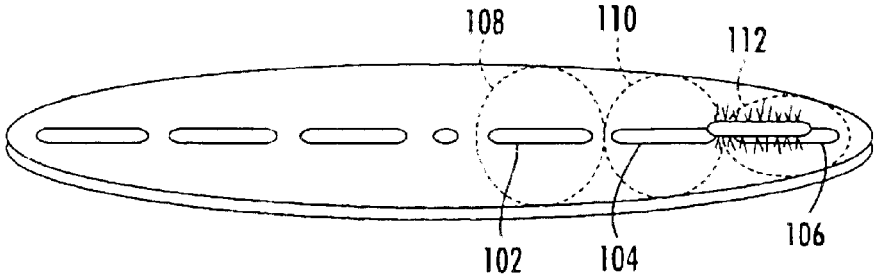

More particularly, as shown in FIGS. 5A–5C, arm 100, FIG. 5A, is first orientated about flow slot 104 (typically the center flow slot of a three flow slot per side steam generator design) to spray water in sector 110 proximate flow slot 104; the arm is then moved over within flow slot 104 to spray water in sector 108, FIG. 5B; and finally the arm is caused to swing over to clean sector 112, FIG. 5C, proximate flow slot 106.

In this way, one complete side of the steam generator is cleaned while the cleaning head deployment and support equipment extends through one series of vertically aligned flow slots. So, the bulk cleaning head subsystem is deployed to top flow slot 25, FIG. 1, within top support plate 26 and the cleaning operation depicted in FIGS. 5A–5C is accomplished (pitch changes made as necessary) and this process is repeated at each level of the steam generator down to the first tubes support plate 14 effecting top to bottom cleaning and thereby flushing deposits downward during the cleaning process. The other side of the steam generator is cleaned in the same manner.

Another aspect of this invention involves using specific nozzle alignment for bulk cleaning to maximize cleaning effectiveness with a minimum use of water. Specifically, the nozzles 84, 88 etc. are aligned first on one side of the tube gap 79, and then on the other side of the tube gap 79 to clean one side of the tubes and then the other. In testing, this procedure had a significant impact on the cleaning effectiveness and was instrumental in increasing the amount of sludge removed from the tube surfaces. Other testing variables included sludge type, nozzle pressure, nozzle flow rate, tilt speed, bulk cleaner location, nozzle design, and nozzle alignment. A prototype design proved that a bulk cleaning head directing water from the blow down lane can remove tube surface deposits and clean support plates and quatrefoils. Still another aspect of this the cleaning methodology of this invention involves slowly lowering the level of water within the steam generator as cleaning progresses top to bottom with the cleaning heads. In this way, additional agitation is provided and cleaning is enhanced as the nozzle jet spray strikes the surface of the water within the generator.

Figure 6:
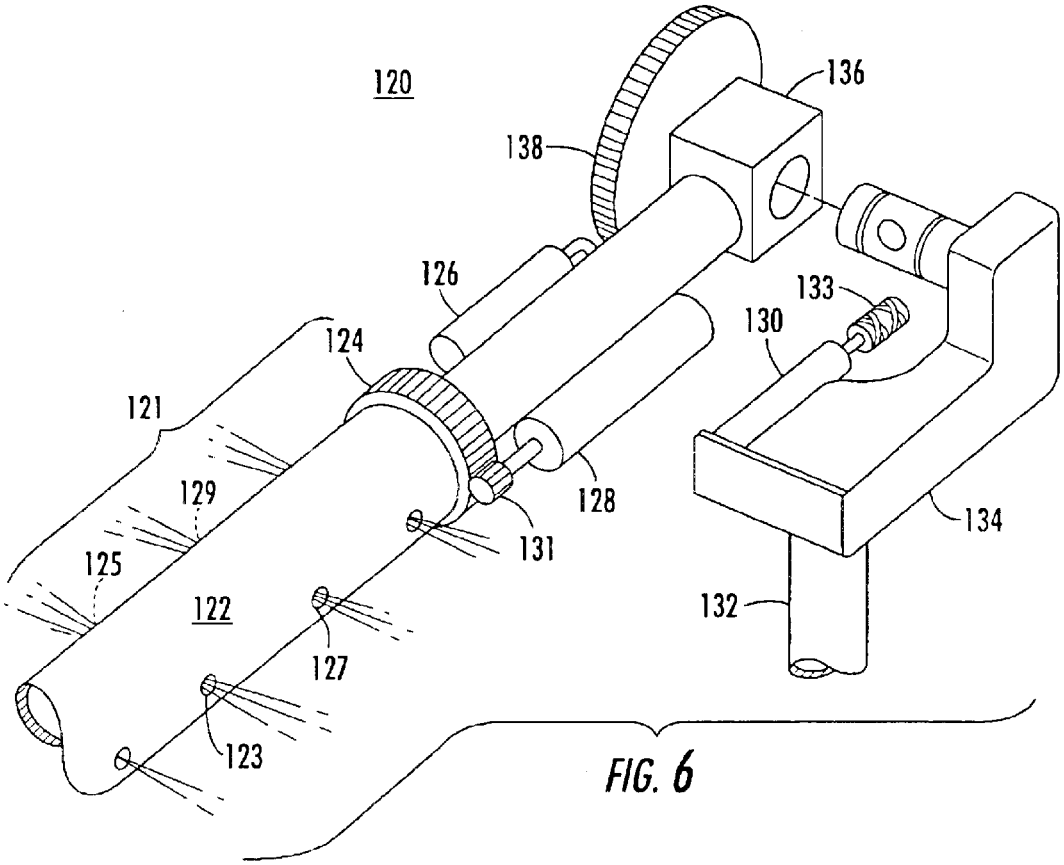
FIG. 6 is a schematic view of the various components of the bulk cleaning head subsystem depicting the mechanisms which effect spray pitch control and swinging of the spray nozzle arm.

FIG. 6 schematically shows the prototype design of bulk cleaning head subsystem 120. Nozzle arm 121 includes barrel portion 122 having opposing nozzles 123, 125, 127, 129, the pitch of which are varied by tilt gear 124 powered by tilt motor 128 by means of gear 131. Swinging of arm 121 is accomplished by means of swing gear 138 powered by swing motor 130 through worm gear 133. Water is supplied to nozzles 123, 125, 127, and 129 through umbilical source 132 thorough water manifold 134. Camera 126 provides the operator with alignment and inspection compatibility. Power for camera 126, motor 130 and motor 128 is provided thorough umbilical source 132.

The Rigid Lance

Figure 7D:
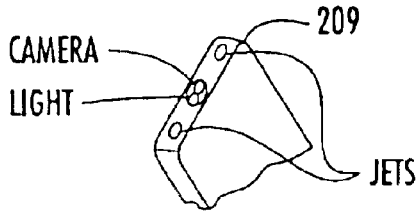
FIGS. 7A–7D are schematic views of the rigid lance cleaning head subsystem of this invention used which is inserted in between the tubes thereby directing water under pressure in between the tubes of the steam generator from between the tubes.
Figure 7A:
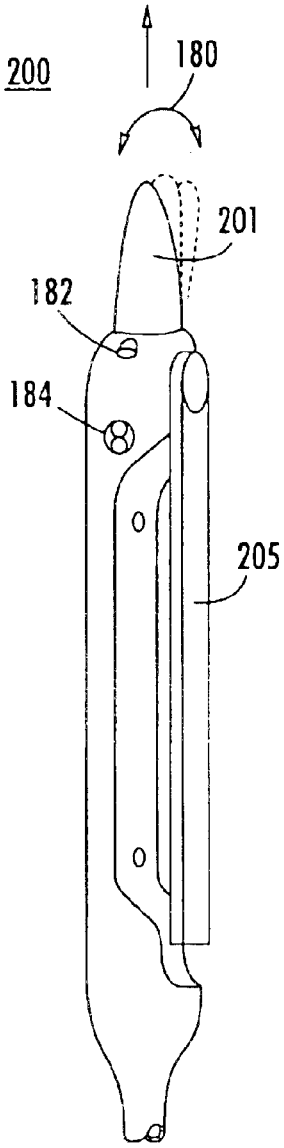
Figure 7B:
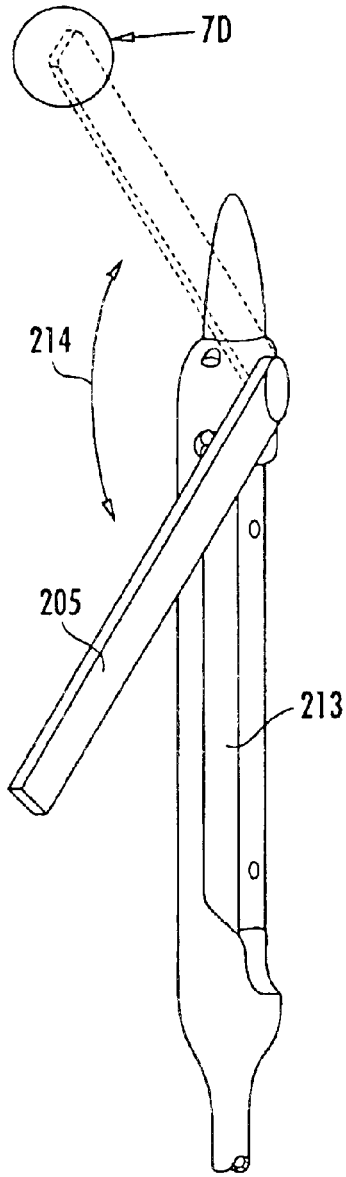
Figure 7C:
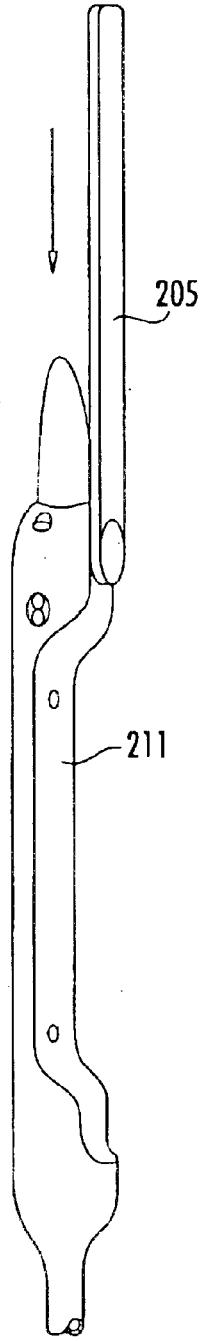
Figures 8A, 8B, 8C:
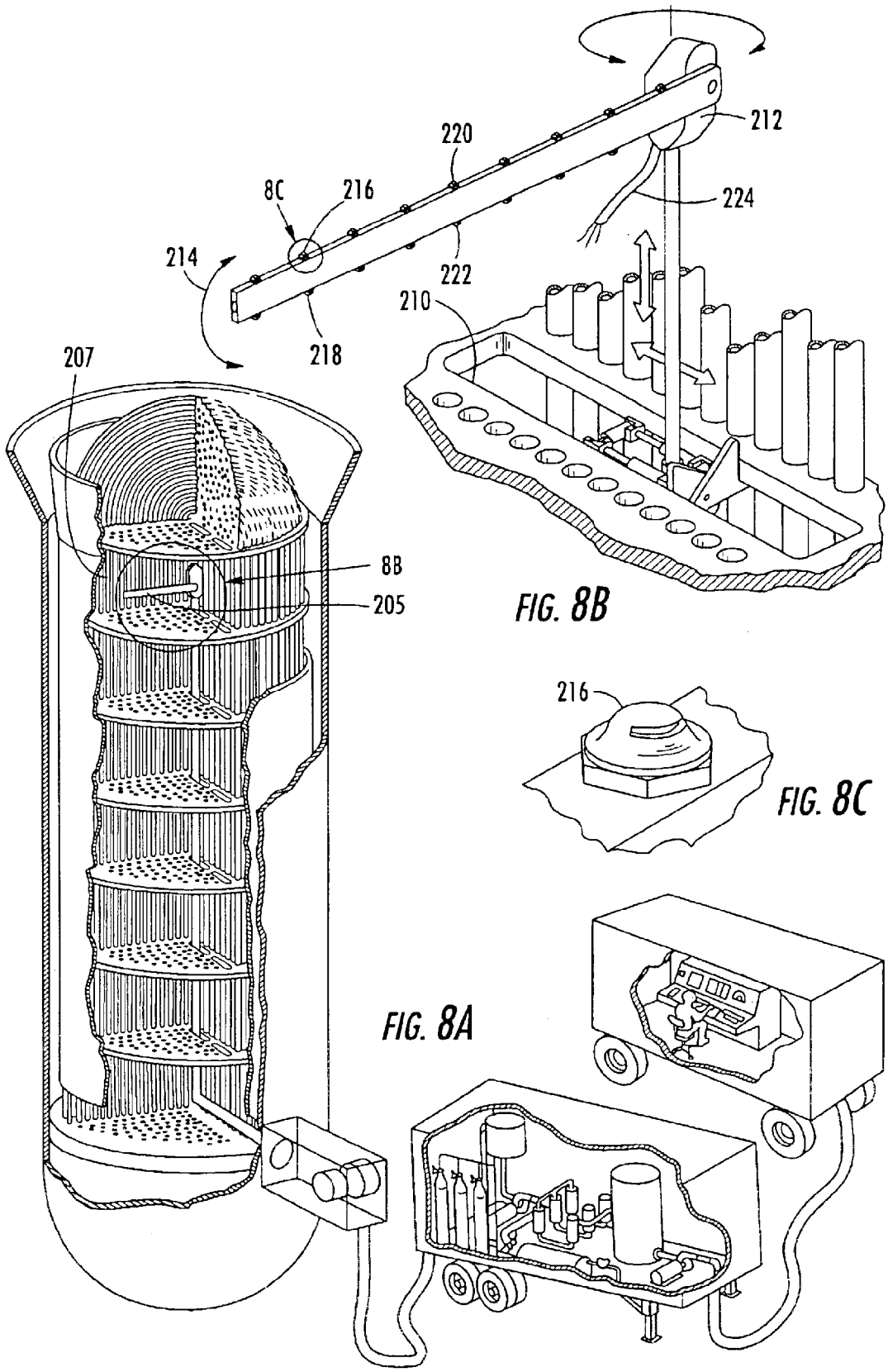
FIGS. 8A–8C are schematic views of the rigid lance of FIGS. 7A–7C shown in place at one level of a steam generator.

Rigid lance 200, FIG. 7A, is another type of spray head mountable to deployment subsystem 50, FIG. 2, and is used to direct fluid in between the rows of tubes from between the tubes. Lance portion 205, FIG. 7A, rotates as shown in FIGS. 7B and 7C to a position as shown in FIG. 8A extending between tube row 207. In this way, lance 205, FIG. 7A, is positioned in line with the top cylinder of the support subsystem during deployment up through flow slot 210, FIG. 8B, where it is then rotated in the direction shown by arrow 214 by lance drive motor 212 to extend between a particular row of tubes. Then, jet nozzles 216, (FIGS. 8B and 8C) 218, 220, and 222 direct fluid from high pressure water source 224 to the tubes.

Figure 9:
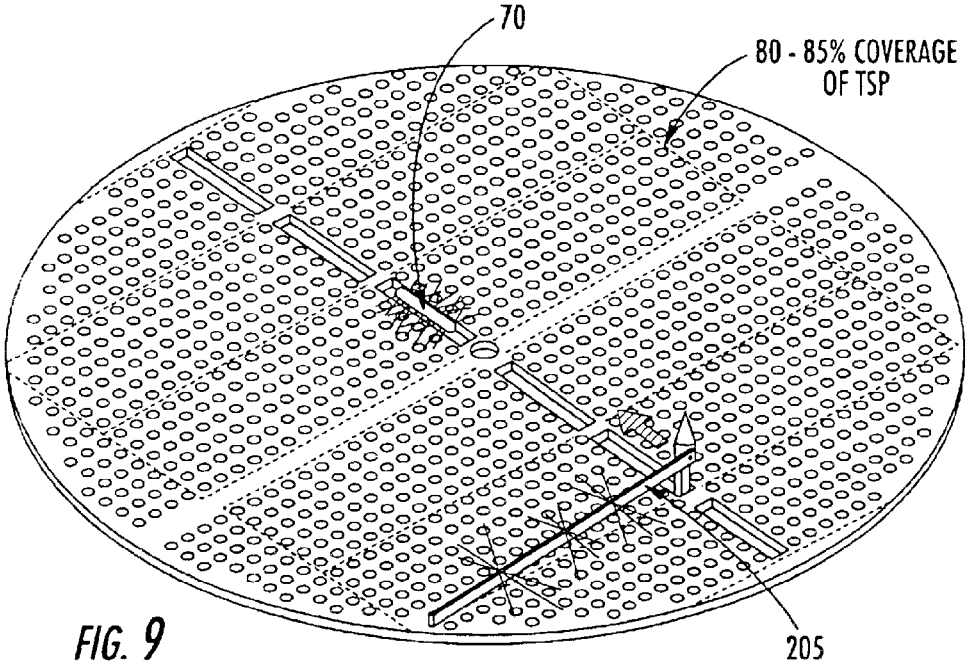
FIG. 9 is a schematic view showing typical tube support plate coverage utilizing both the bulk cleaning head subsystem and the rigid lance according to this invention.

As shown in FIG. 9 the areas of tubes not cleaned using bulk cleaning head subsystem 70 which sprays water from a flow slot are cleaned using lance 205 which can be inserted between rows of tubes. At the upper most end of rigid lance 200, FIG. 7A is bullet nose piece 201 which can be manually inclined slightly as shown by arrow 108 to snake its way up through the flow slots regardless of minor slot misalignment or flexibility of the telescoping cylinder assembly of the deployment/support device shown in FIG. 2. Bullet nose 201 is deflected with the use of one cable tether which works against an offset spring. By rotating the head around its vertical axis with the rotary stage, the nose deflection can be orientated in any direction. Since the rigid lance subsystem cleaning head will be traveling into regions from which significant amounts of sensory data must be obtained, it is essential that the head be outfitted with several eyes 182, 184 to keep the operator up to date on its whereabouts and the status of the inspection and cleaning activities.

To enable the operator to align the bullet nose 201 with the next flow slot as the head traverses up to the tube sheet support plate of interest, one CCD video camera is mounted within the head and aimed upwards as shown for camera 184. If appropriate, two video cameras would be mounted in horizontal opposition in the head to enable viewing down the no tube lane and at the tubes immediately adjacent thereto. To provide viewing capability in the intertube lanes, video probes can be mounted on the lance tip 209 shown in FIG. 7D. CCD chips are positioned to enable inspection of the crevice areas and observation of the water jetting operations. The cables for these videos probes are routed through the rotary stage on the blow down lane cart and out the hand hole. To simplify the user interface, the signals would be multiplexed to a remote operator station where the video image of choice can be displayed. As indicated in FIG. 7C, if slightly reduced coverage of the intertube lanes is not acceptable at the tube sheet support plate, the recess 211 in the head formed by the offset as shown can serve to hold an optional tooling module 213 shown in FIG. 7B to suit the task at hand. For example, a sample holding bin can be mounted at this point so that tube scale could be reliably transported out of the steam generator for analysis.

In general, the intertube lance of this invention accomplishes visual inspection, crevice cleaning, tube descaling, tube sheet plate flushing, corrosion sampling, and foreign object search and retrieval. Lance 205 must be as long as possible but cannot exceed the vertical spacing of the tube sheet support plates or else it can not be rotated from the vertical. Since the radii of both the W44 and the W51 generator tube sheet plates are greater than the vertical spacing of the tube sheet plates, there is an area shown in FIG. 9 that the rigid lance cannot reach at the furthest point from the no tube lane. The total percent area that is within the reach of the rigid lance, however, is estimated to be over 85% for the W44 and over 80% for the W51.

Lance 200, FIGS. 7A–7C is a slender 2½" diameter housing inside which is mounted a rotary drive (not shown) to position the rigid 1/4" arm 205. Water jets at the tip of the lance are orientated so that they direct debris back toward the flow slots in the no tube lance since there is no reliable means to move debris from the periphery of the tube support plate.

Figure 10A:
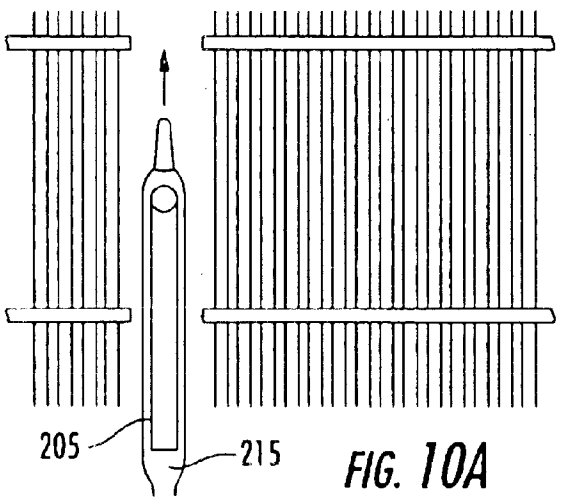
FIGS. 10A–10D are schematic views showing the various positions for inspecting, cleaning, and descaling tube bundles using the rigid lance of FIGS. 6–7.
Figure 10B:
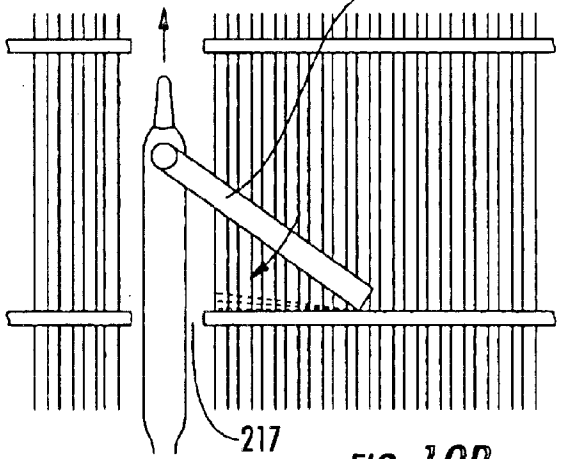
Figure 10C:
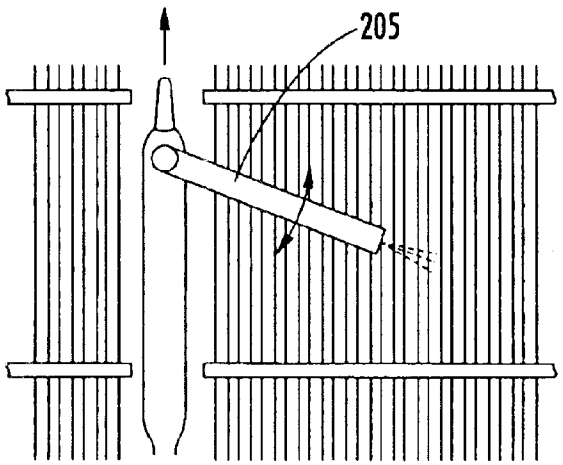
Figure 10D:
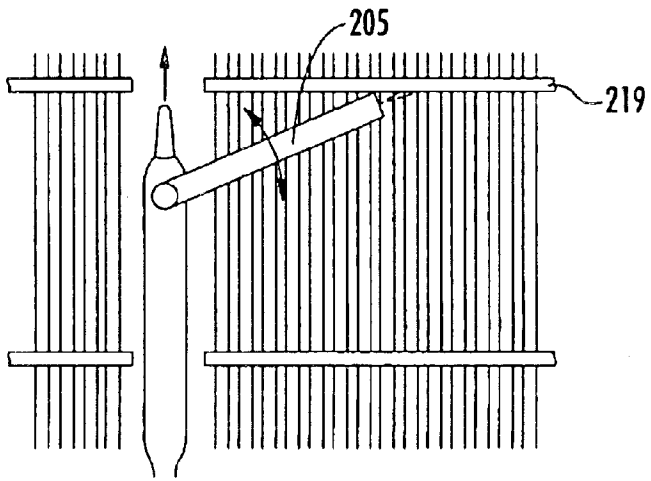

FIGS. 10A–10D show the orientation of the lance with respect to the head during deployment and various cleaning operations. FIG. 10A shows lance 205 aligned with head 215 for deployment and raising the cleaning head to the tube sheet support plate of interest; FIG. 10B shows a downward sweeping action of lance 205 to flush debris towards flow slot 217; FIG. 10C depicts lance 205 sweeping back and forth for descaling the tubes; while FIG. 10D depicts lance 205 in position for inspecting the under side of tube support plate 219.

The Support Mechanism

Figure 11:
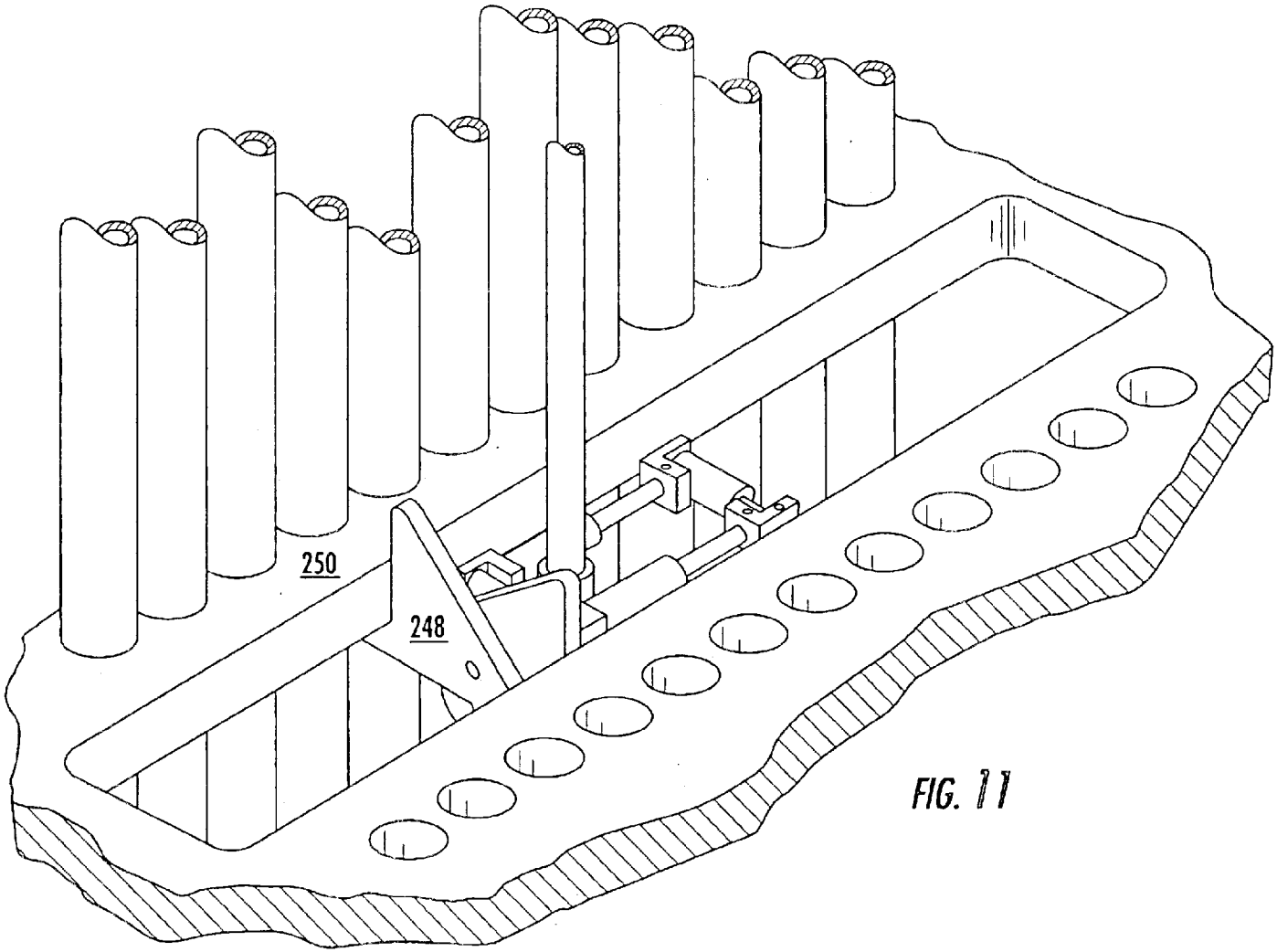
FIG. 11 is a schematic three dimensional view of the support subsystem of this invention for maintaining a particular cleaning head in position during the application of high pressure fluid to the cleaning head.

Although the vertical deployment and support system will be laterally supported on the bottom of the tube sheet, it is necessary to provide lateral support at the top proximate the deployed spray head as well. During cleaning of the upper spans of the steam generator, the vertical deployment and support system will be extended up to 25 feet. Sideloads will be applied during lance insertion into and retraction from the tube bundle as well as during jet sweeping operations. The upper lateral support subsystem of this invention is shown in FIG. 11 and provides mechanical engagement with and disengagement from a tube support plate such as tube support plate 250 and requires no additional actuators.

Figure 12C:
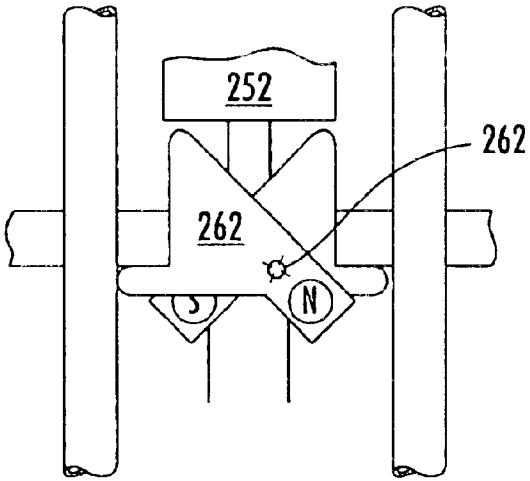
FIGS. 12A–12C are schematic front views showing the support subsystem passing through and ultimately engaging a support plate of a typical steam generator.
Figure 12B:
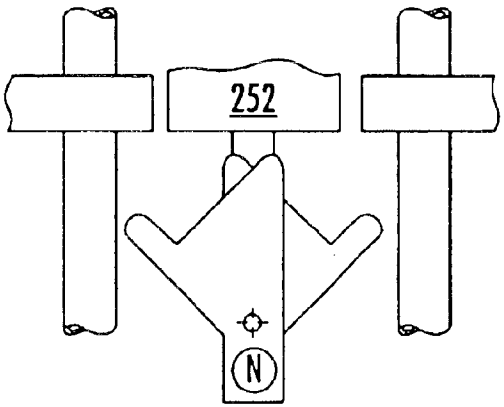
Figure 12A:
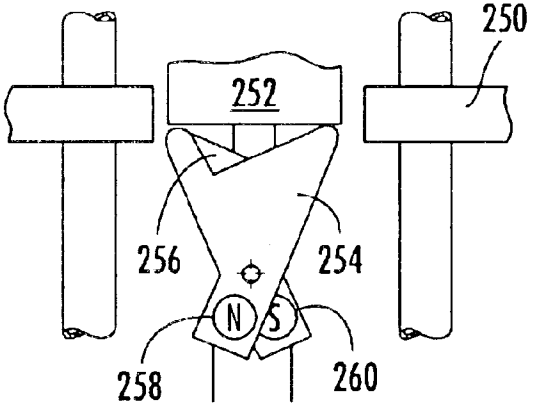

As shown in FIG. 12A, upon approaching the tube support plate 250 of interest, the pay load 252 (one of the spray heads discussed above) is lifted slightly to allow fingers 254 and 256 to open as shown in FIG. 12B. Magnets 258 and 260 assist indexing to a position shown in FIG. 12B. With fingers 254 and 256 in the open position, further extension of the vertical deployment system will rotate the fingers into the locked positioned as shown in FIG. 12C. Cleaning operations are then conducted using the vertical motion of the upper most cylinder of the deployment/subsystem shown in FIG. 2 with the lateral support system locked and the cylinders below stationary. Disengagement is accomplished by a reversing the procedure. The lower cylinders are retracted which will pull down on the lateral support system pivot pin 262 and friction on the pads which bear against the flow slot cause the finger assemblies to rotate into the position shown in FIG. 12B as the lower cylinders are retracted. The retraction of the independent upper cylinder would then cause the fingers to fold into the stowed positioned as shown in FIG. 12A and permit passage through the flow slots to a new deployment location.

Retrieval is a concern where any equipment is deployed into the inner regions of the steam generator. Emergency retrieval according to this invention is accomplished by tension on the cylinder extension control cable which is attached to the second stage cylinder. If the fingers are in the stowed positioned as shown in FIG. 12B, when emergency retrieval is initiated, no interference will occur. If the fingers are in the ready position as shown in FIG. 12B, contact with each tube support plate on the way down will simply rotate them inwardly sufficient to pass through the flow slot. If the lateral support system is engaged as shown in FIG. 12C, when emergency retrieval is initiated, sufficient tension will be applied to the cable to overcome the friction associated with the lateral support system contact with the tube support plate. If the pay load is completely down and resting on the fingers, contact with the next support plate during retraction rotates the fingers inward and lifts the payload to the stowed configuration of FIG. 12A.

Other Subsystems

Figure 13:
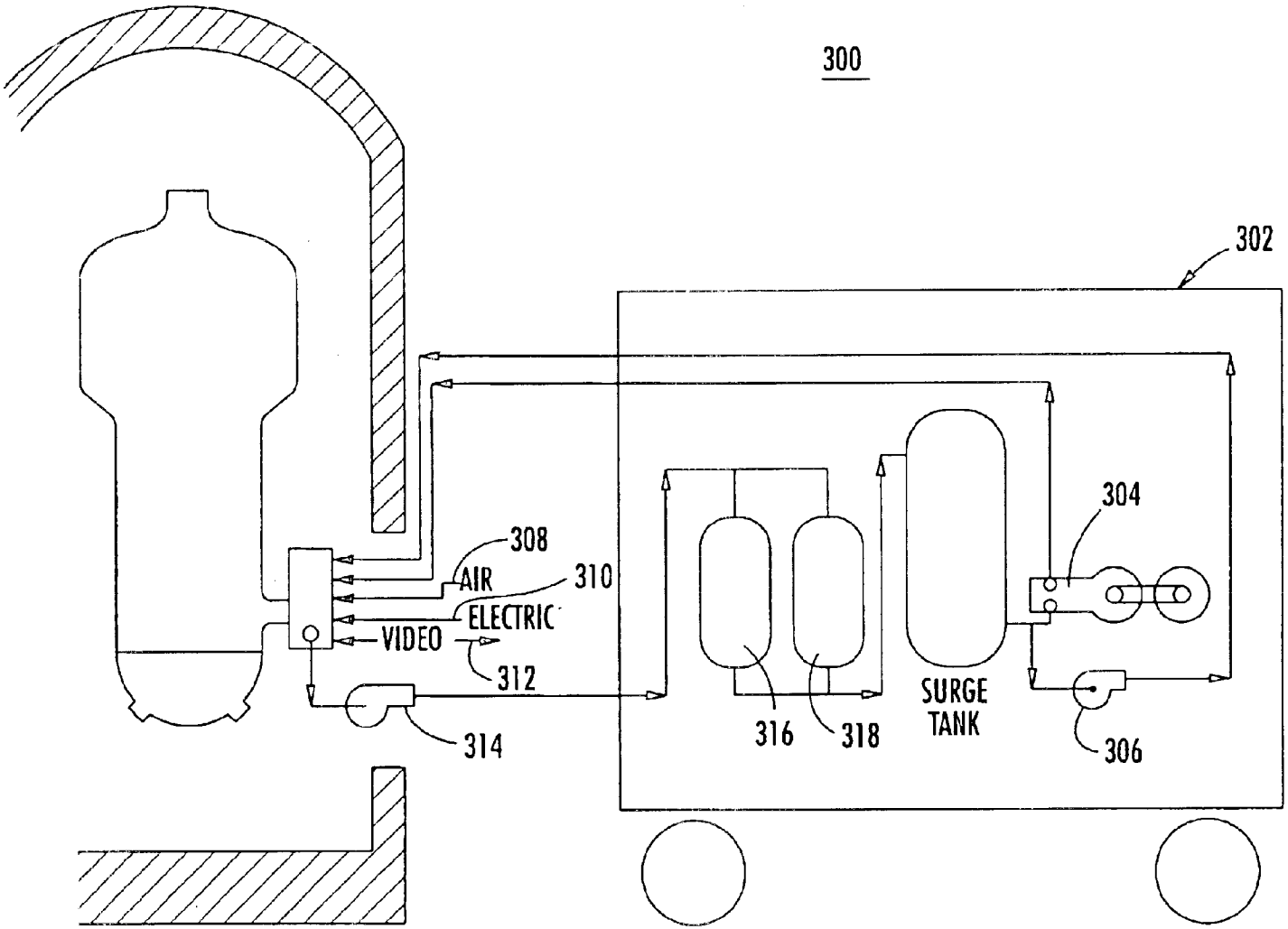
FIG. 13 is a schematic view of the process system of this invention for supplying water and video hook ups to the cleaning heads of this invention.

There is shown in FIG. 13 process subsystem 300 which supplies high pressure water to the jets of each spray head, low pressure water to the vertical deployment system cylinders, air and electric power as needed and video feedback from the cleaning system. Process subsystem 300 also provides for suction from the steam generator to maintains a stable level during lancing and it will filter that water sufficiently for recirculation to the water jet spray nozzles of the cleaning heads. The majority of the process system will be located in trailer 302 outside of the containment building and is very similar to that employed for tube sheet sludge lancing today. High pressure water is supplied to the nozzle jet of each cleaning head via high pressure pump 304, low pressure water is supplied to the deployment/support subsystem cylinders by low pressure pump 306 and air electric, and video signals are transmitted via lines 308, 310 and 312 respectively. Suction pump 314 maintain a stable level during lancing and filters 316 and 318 filter the water from pump 314 sufficiently for recirculization to the water jet spray nozzles via high pressure pump 304.

Figure 14:
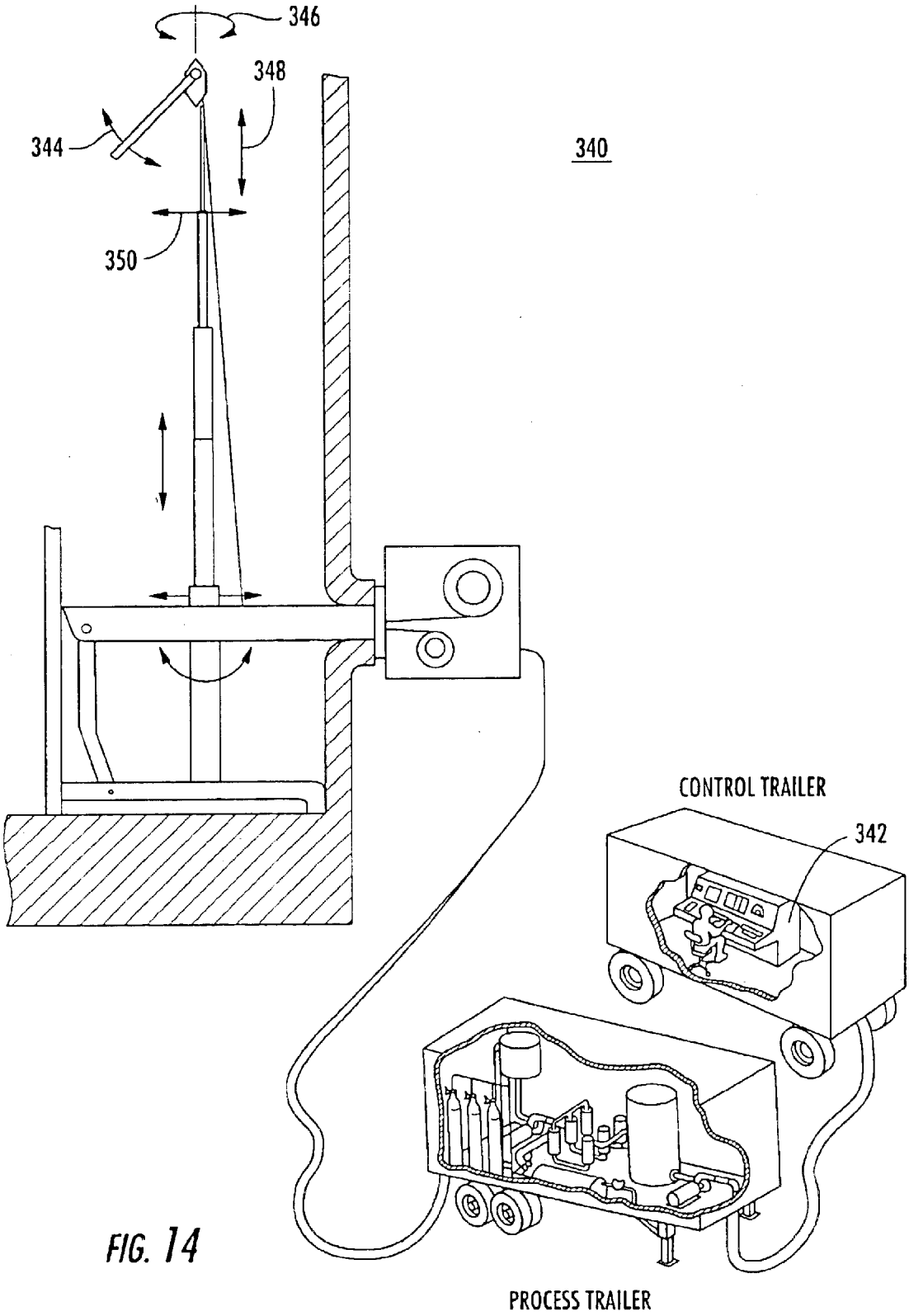
FIG. 14 is a schematic view of a control subsystem of this invention used to deploy and manipulate the cleaning heads of this invention within the steam generator during cleaning.

The control subsystem 340 shown in FIG. 14 provides the means of controlling all process system functions as well as those of the vertical deployment/support systems and intertube access rigid wand subsystems. All major system actuations are under closed-loop control with position feed back from encoders. A computer interface as shown at 342 provides control as well as position and function information. Relative motions, such as jet sweeping in the tube gaps as depicted by arrow 344, rotation of the cleaning head as depicted by arrow 346, raising and lowering of the cylinders of the deployment/support subsystem as depicted by arrow 348 and translational movement of the deployment subsystem as depicted by arrow 350 to affect cleaning according to the methodology depicted in FIGS. 5A–5C is programmed for automatic execution. The control console also includes a monitor for the video system. The intertube access system must enter the 0.406" gaps and utilizes a Welch Allyn video probe, customized to 0.250" diameter.

Cleaning, Inspection, and Repair Subassemblies

Figure 15:
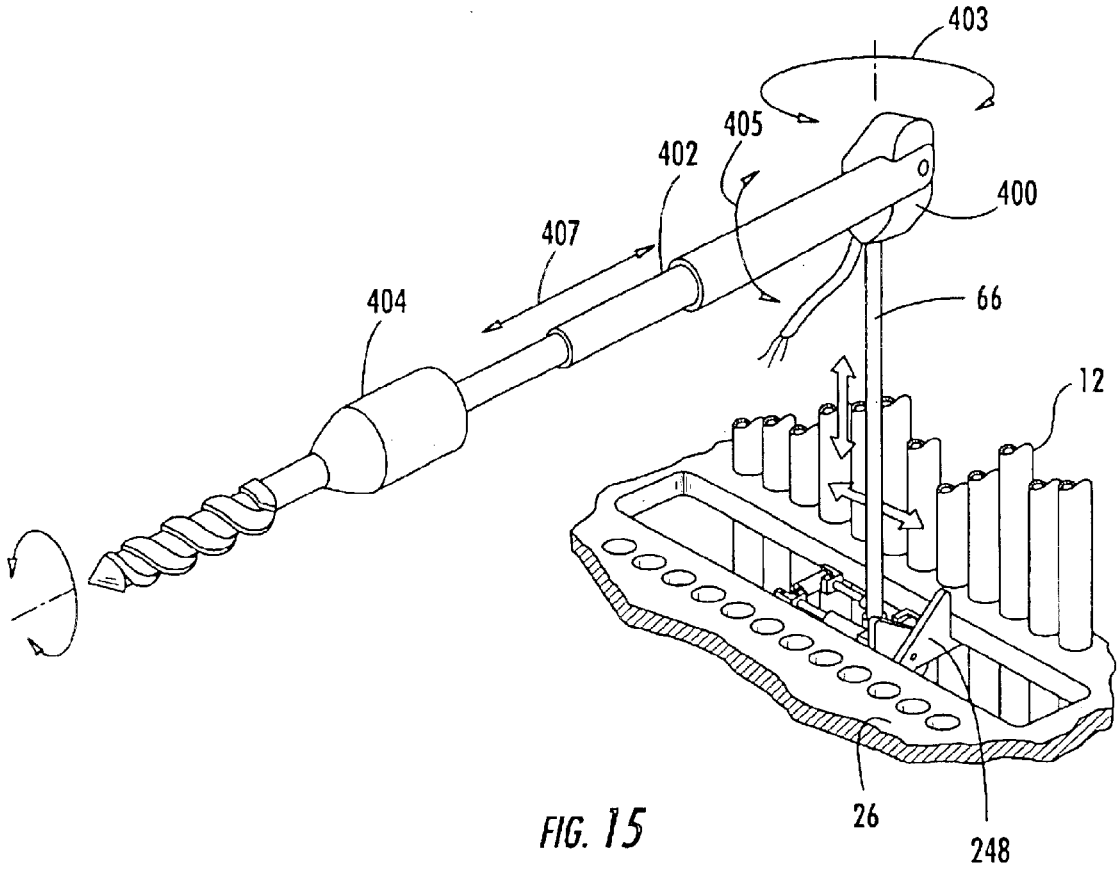
FIG. 15 is a schematic view of the telescoping arm subsystem of this invention deploying a drill assembly.

As shown in FIG. 15, telescoping arm 402 may be attached via rotating joint 400 to the upper most hydraulic cylinder 66 of the deployment and support device shown in FIG. 2. Rotating joint 400 may be similar to the elbow joint shown in the '129 patent. On the distal end of telescoping arm 402 is drill assembly 404 for drilling operations about the upper tubes and the tube support plates such as shown for support plate 26 and tubes 12. Rotating joint 400 rotates arm 402 horizontally as shown by arrow 403 and also vertically as shown by arrow 405. Support mechanism 248, also shown in FIG. 11, maintains upper hydraulic cylinder 66 in a fixed relationship with respect to the flow slot of plate 26. While telescoping arm 402 and drill assembly 404 are being raised into position up through the flow slots in the support plates, telescoping arm 402 and drill assembly 404 are aligned coincident with upper hydraulic cylinder 66 of the deployment and support device shown in FIG. 2. Once the desired level within the steam generator is reached, rotatable mechanism 400 articulates arm 402 vertically upward as shown by arrow 405 and the individual telescoping elements of telescoping arm 402 then extend in the direction of arrow 407.

Figure 16:
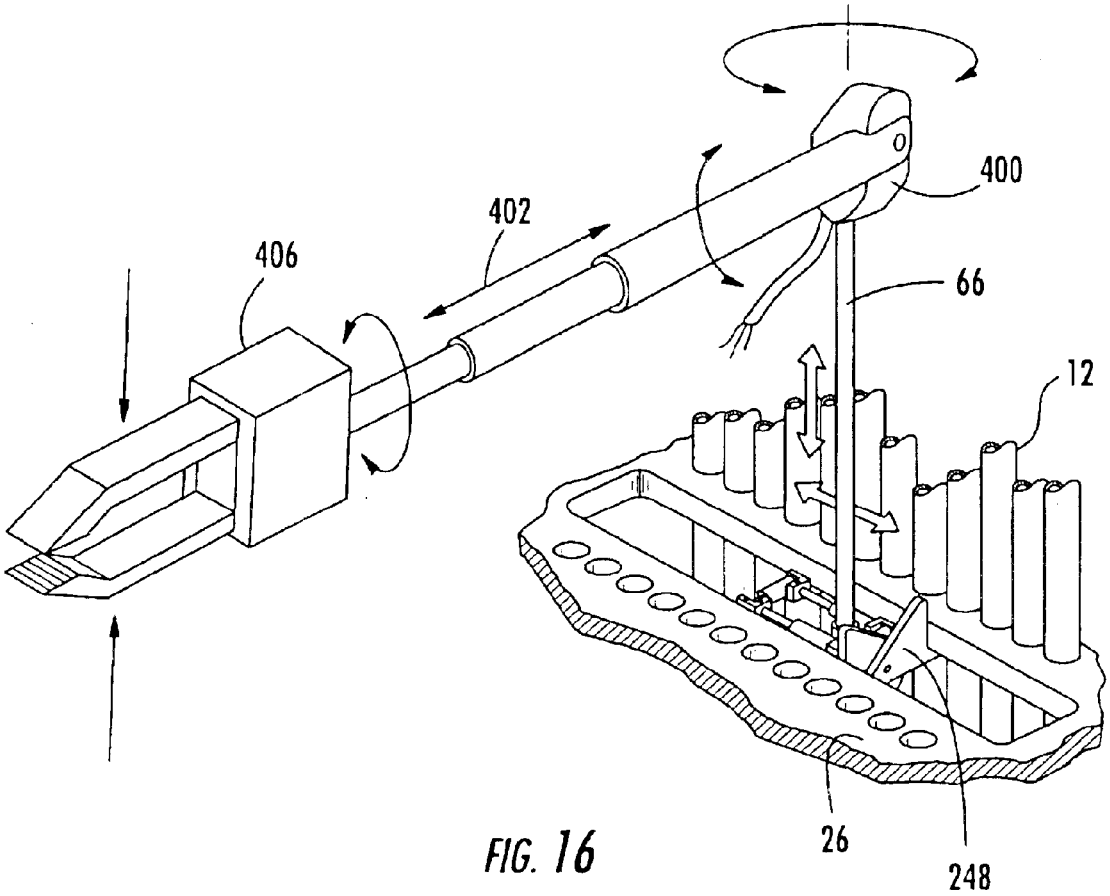
FIG. 16 is a schematic view of the telescoping arm subsystem of FIG. 15 deploying a gripper assembly.
Figure 17:
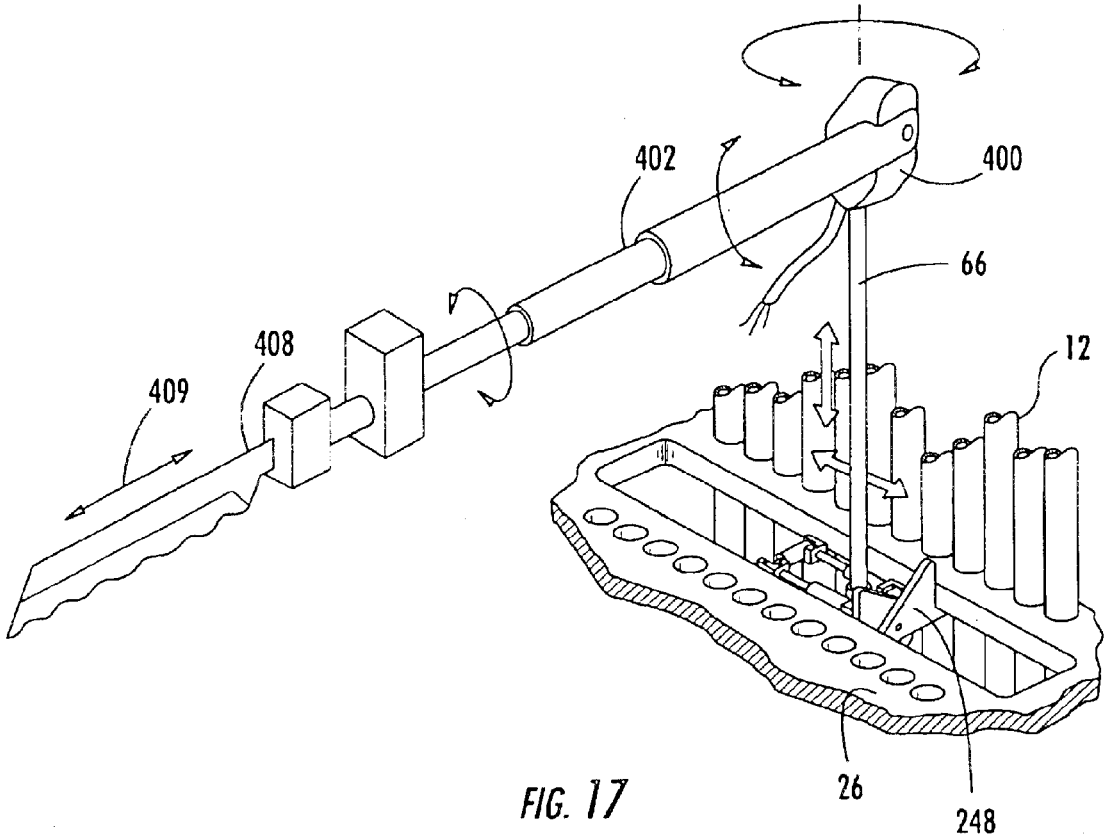
FIG. 17 is a schematic view of the telescoping arm subsystem of FIG. 15 deploying a saw assembly.

Gripper assembly 406, FIG. 16 may also be attached to telescoping arm 402 for retrieving objects about the upper bundles of the steam generator. Cutting may be accomplished by saw assembly 408, FIG. 17, attached to telescoping arm 402 or by an Electrode Discharge Machine (EDM) head for performing various operations attached to arm 402. Saw assembly 408 may be a reciprocating saw providing a sawing action as shown by arrow 409.

Figure 18:
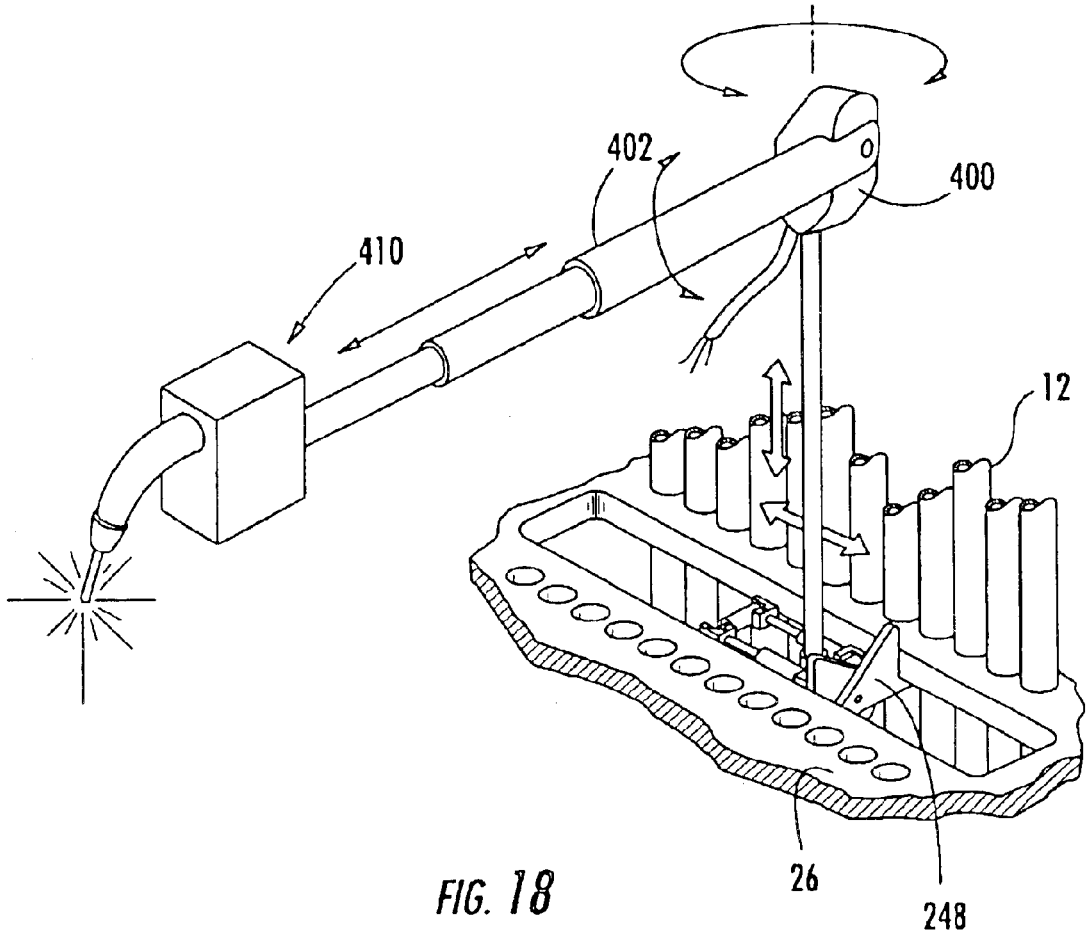
FIG. 18 is a schematic view of the telescoping arm subsystem of FIG. 15 deploying a welder.

Telescoping arm 402, FIG. 18, may also include welder assembly 410 for performing welding operations within the steam generator. Welding may be performed using an electric arc technique or by using a laser beam delivered to the welding site by an optical fiber.

Figure 19:
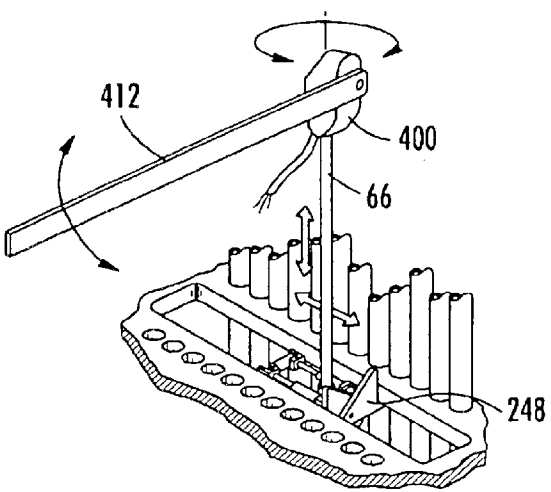

It is very important that any device which extends upwards of 30 feet within the steam generator and then outward between the individual tubes does not become jammed or otherwise disabled within the steam generator. Accordingly, arm 412, FIG. 19 is a flexible lance made of graphite or some other suitably flexible material so that the arm is pliable enough to be withdrawn from within the interior of the steam generator. In another embodiment, arm 413 includes two sections 414 and 415 as shown. Arm section 414 may be very flexible while arm section 415 may be somewhat more rigid. Arm 414 may be extendible outward in the direction shown by arrow 417 through the use of telescoping cylinders or an equivalent mechanism or it may be pivotable with respect to arm section 415 in the direction shown by arrow 419 for compact deployment through the flow slots of the steam generator. In another embodiment, it may be desirable to fabricate arm section 415 of a more flexible material, and arm section 414 or a more rigid material. Arm section 414 may include cleaning nozzles 421, video camera 423, and/or drill assembly 404, FIG. 15, gripper assembly 406, FIG. 16, saw assembly 408, FIG. 17, and/or welder 410, FIG. 18. [should describe in more detail]

Figure 21:
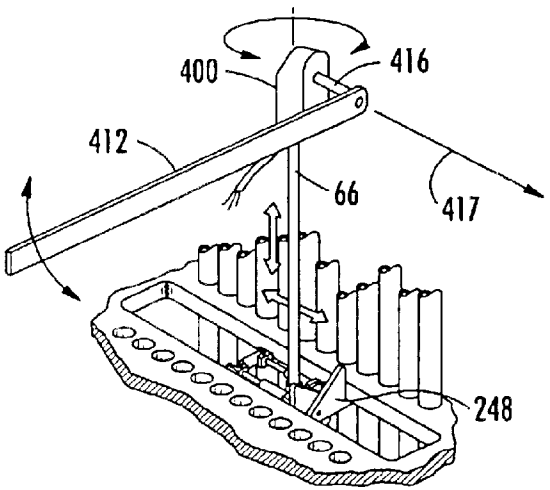
FIGS. 19–22 are schematic views of different embodiments of the flexible lance subsystem of this invention.

In another embodiment, arm 412, FIG. 21, may be attached to rotatable mechanism 400 through the use of offset mechanism 416 used to position arm 412 among the tube bundles. Offset mechanism 416 may be adjustable in the direction shown by arrow 417 to move arm 412 once boom 66 is locked in place via support mechanism 248.

Figure 22:
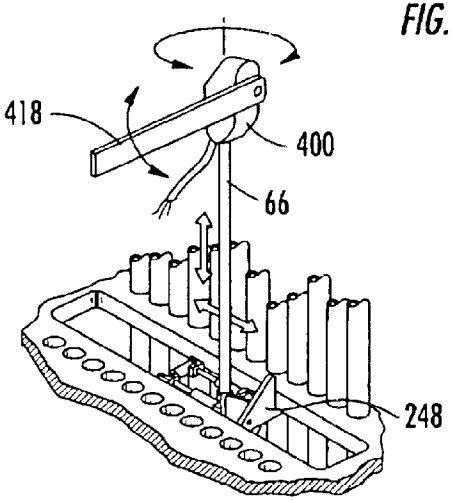
Figure 23:
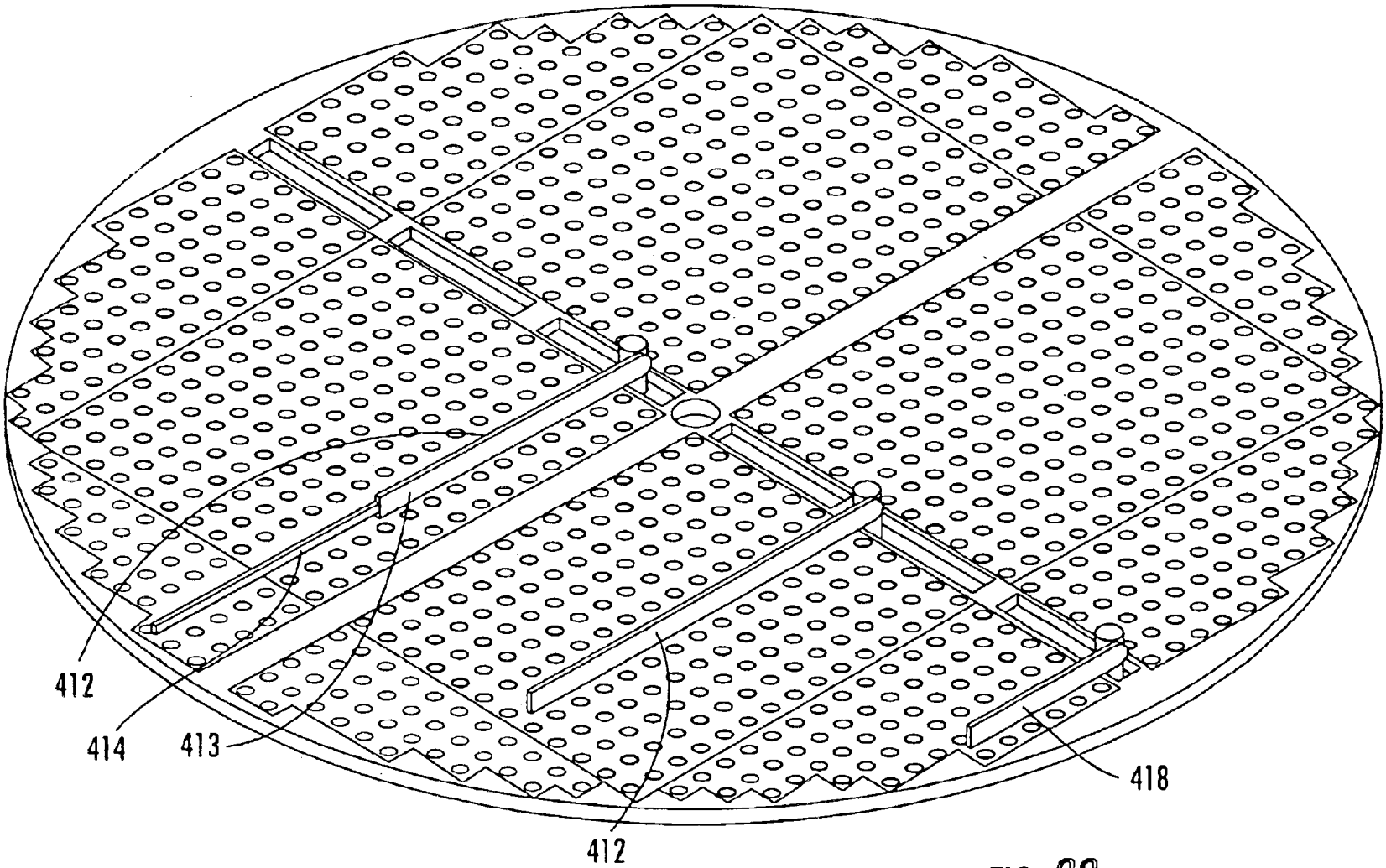
FIG. 23 is a schematic view of the flexible lance subsystem deployed within a steam generator in accordance with the subject invention.

In another embodiment, shorter arm 418, FIG. 22 is used as shown in FIG. 23 to clean, inspect, or repair the tubes about the shorter tubes lanes. Arm 412, FIG. 19, is used to clean, inspect, or repair tubes about the longer tube lane of the steam generator, and arm 413 with arm sections 412 and 414 are used to clean, inspect, and repair tubes about the deepest portions of the tubes lanes within the steam generator. See FIG. 23.

Figure 20:
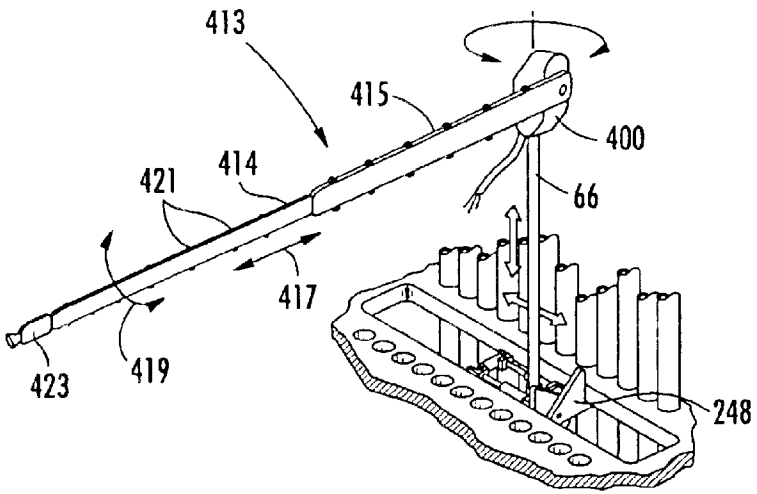

Thus, the system of this invention facilitates cleaning, inspection, and repair or rework of the upper tube bundles. Gripper assembly 406, FIG. 16, may be used to hold a welding rod or a bar or bracket, while welder assembly 410, FIG. 18 is used to weld an individual tube. Camera 423, FIG. 20, may be used to inspect and monitor the work in process.

Alternative Deployment Subsystems

Although deployment subsystem 50, FIG. 2 may be used to deploy the various cleaning, inspection, and repair devices shown in FIGS. 3, 6, 7, and 15–22, other deployment subsystems may be used since the boom and telescoping cylinders combination (FIG. 2) which in its collapsed state is only 18 inches tall and which must still extend up to 30 feet is difficult to design, manufacture, and control. Moreover, this design requires that the boom 70 be placed inside the steam generator.

Figure 24:
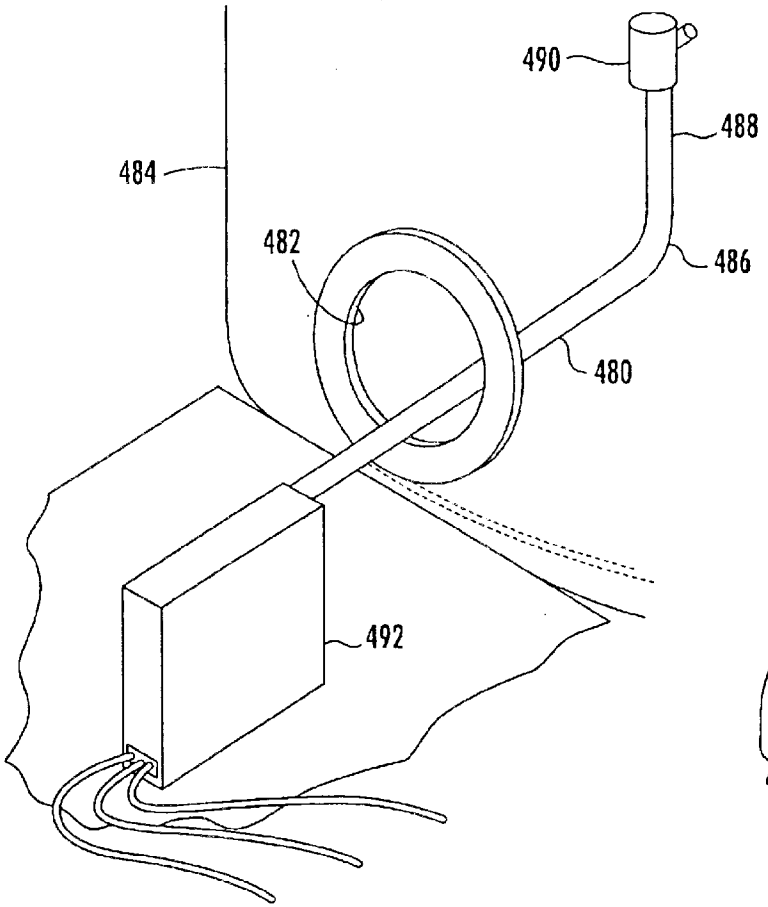
FIG. 24 is a schematic view of the deployment system of this invention which employs an elongated body flexible in one configuration and fairly rigid in another configuration.

In contrast, the invention of this application includes an elongated body 480, FIG. 24 feedable through hand hole 482 from outside steam generator 484. Elongated body 480 is flexible enough to bend into position to travel upwards as shown at 486 and also rigid in another configuration as shown at 488 for positioning a cleaning head/inspection and/or repair device up through the steam generator to reach the upper tube bundles.

There are some means 492 for driving elongated body 480 up through the support plates, and for retracting body 480, FIG. 24, back down through the support plates.

Figure 25:
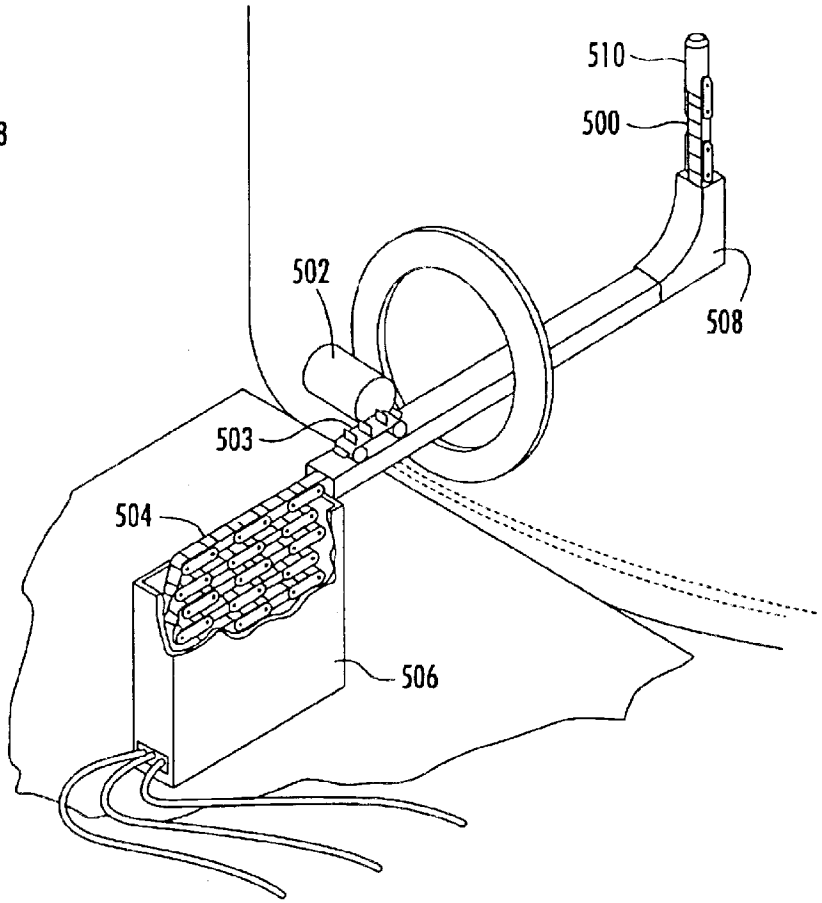
FIG. 25 is a schematic view of a rigid chain embodiment of the elongated body shown in FIG. 24.

In a preferred embodiment, elongated body 480, FIG. 24, is a "rigid chain" 500, FIG. 25 driven by motor 502 and drive assembly 503 as it unfurls from stack 504 in container 506. Turn shoe 508 directs rigid chain 500 to turn upwards carrying inspection/cleaning/repair head 510 to the upper bundles of the steam generator. Rigid chain 500 is flexible enough to make the bend shown at 508 but is also rigid enough to extend upwards after bend 508 and support cleaning and inspection equipment about the upper tube bundles some 30 feet from bend 508.

Other elongated bodies, however, are possible and are within the scope of this invention so long as they are flexible in on configuration to bend into a position for extension up through the flow slots and rigid in another configuration for positioning and supporting cleaning head/inspection devices up through the flow slots in the support plates of the steam generator. The various embodiments are discussed as follows.

Rigid Chains

Figure 26:
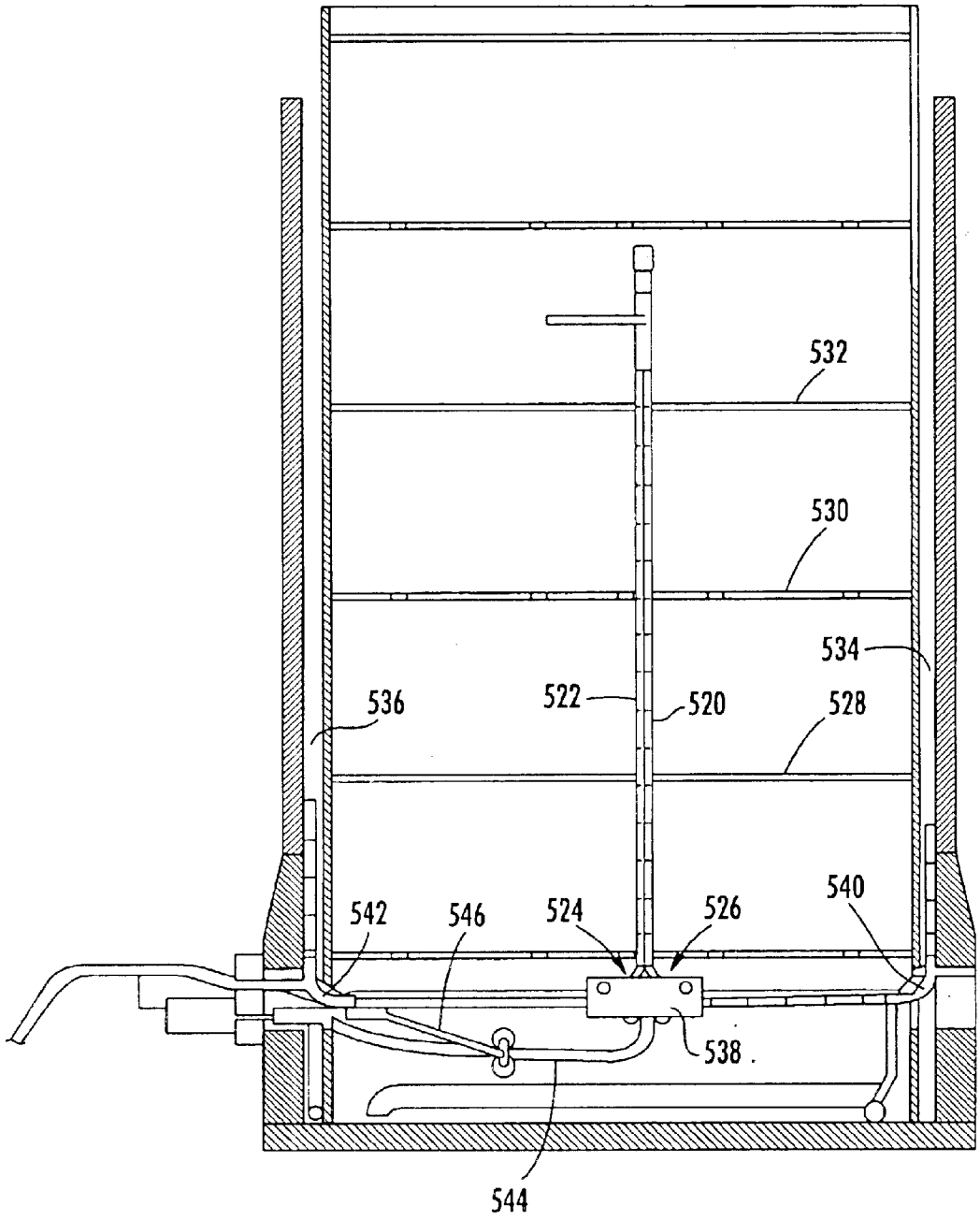
FIG. 26 is a schematic view an embodiment including back to back rigid chains according to this invention.

In on embodiment, there are two rigid chains 520 and 522, FIG. 26. Rigid chain 522 is constructed to bend in only one direction as shown in 524 while rigid chain 520 is constructed to bend only in the opposite direction as shown at 526. When placed back-to-back, the combination is rigid enough to be deployed upward supporting a cleaning head/inspection/and/or repair device up through the flow slots in the tube support plates 528, 530, 532, etc. Rigid chain 520 is deployed in annulus 534 while rigid chain 522 is deployed in annulus 536. Then, both chains are driven by drive 538 through guide shoes 540 and 542 respectively. Video/cleaning fluid/power umbilical 544 is tensioned by tension arm 546.

Figure 29:
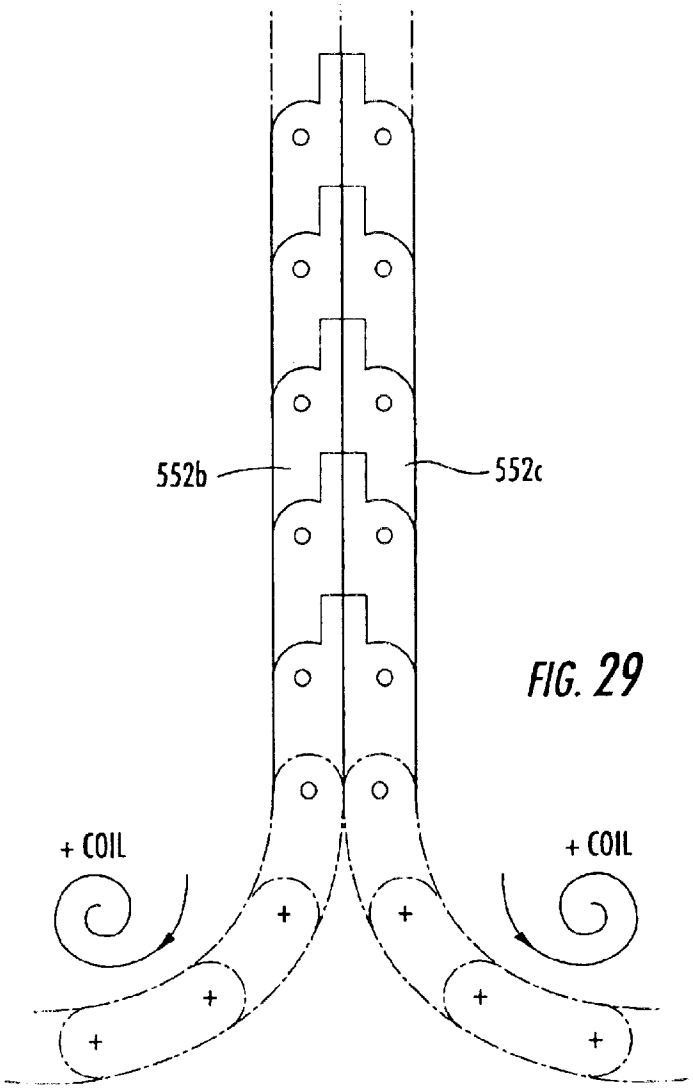
FIG. 29 is a front view of two rigid chains placed back to back in the deployment system of this invention.
Figure 28:
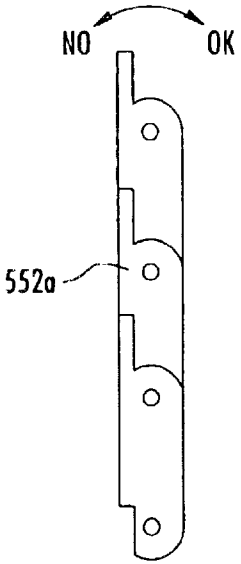
FIG. 28 is a front view of a rigid chain used in the deployment system of this invention.
Figure 27:
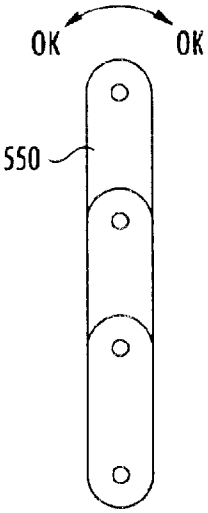
FIG. 27 is a front view of a typical chain linkage.

As shown in FIG. 27 a typical non-rigid chain 550 is free to bend in two directions. Rigid chain 552*a*, FIG. 28, however, is free to bend in only one direction. When two such chains 552*b* and 552*c*, FIG. 29, are placed back to back, a rigid structure is formed from an assembly flexible in one configuration—namely, each chain by itself.

Figure 30:
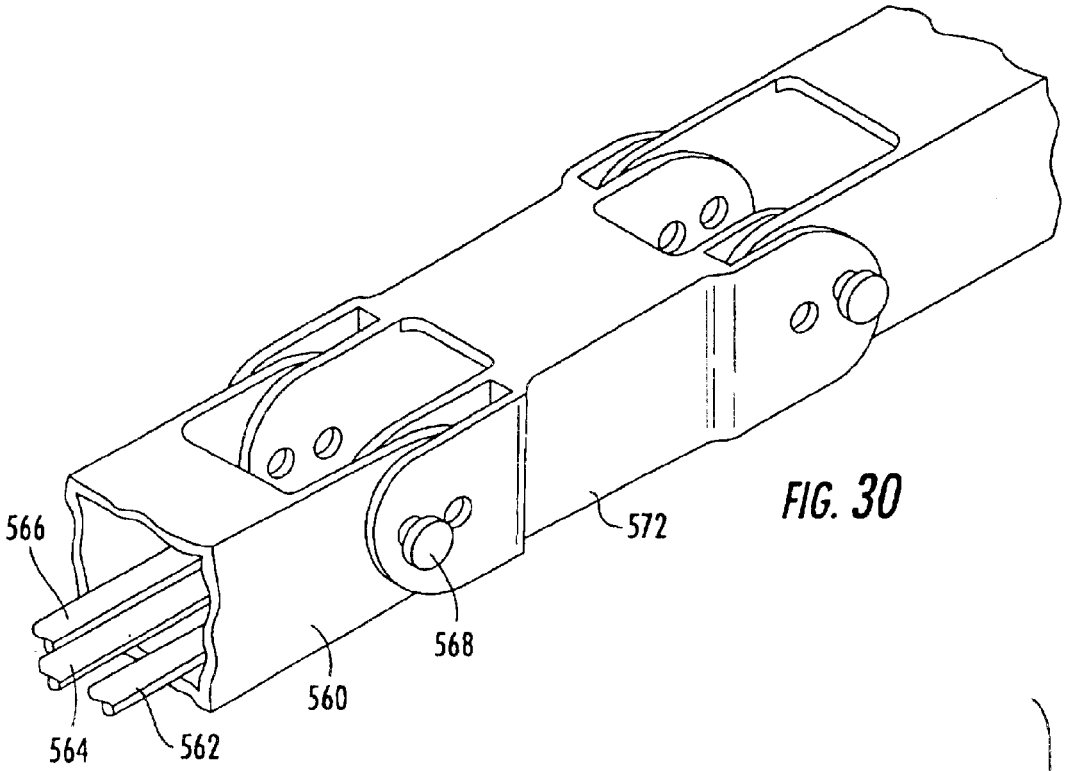
FIGS. 30 and 31 are schematic views of another type of rigid chain used in the deployment system of this invention.

Another rigid chain is shown in FIG. 30. Each link 560 is hollow to carry video 562, cleaning spray 564, and power 566 umbilicals. Pin 568 engages the adjacent link to prevent rotation of the links with respect to each other. Pin 568 also retracts to allow bending of link 572 with respect to link 560.

Figure 31:
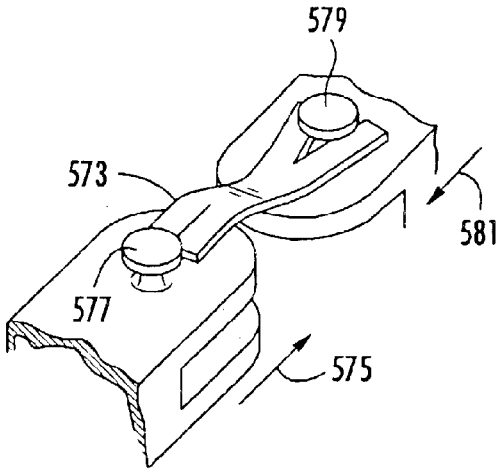

In this embodiment, a pin drive 573, FIG. 31 is used to push the engagement pins in after the 90° turn is made providing a rigid support. The pin drive also pulls the engagement pins out upon retraction of the rigid chain back down through the flow slots of the support plates of the steam generator. Pin drive 577 can be as simple as set of leaf type springs that bear against the top of the pin 577, engaging it in the hole, when pushed from the direction shown by arrow 575. When pin 579 is pulled back, in the direction shown by arrow 581, the leaf springs bear under the pin head, disengaging it from the hole in the links.

Figure 32:
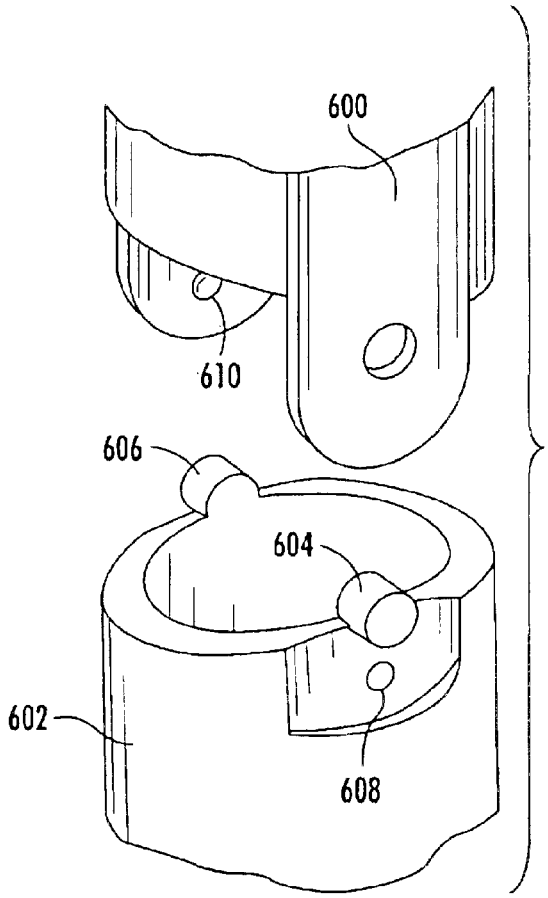
FIG. 32 is a schematic view of still another type of rigid chain used in the deployment system of this invention.

In another embodiment, the rigid chain concept includes link 600, FIG. 32, joined to link 602 by pins 604 and 606. Detent ball 608 on link 602 engages a detent recess 610 on link 600. In this way, link 602 is normally locked with respect to link 600 but upon the application of a sufficient bending force (by pushing the chain through turn shoe 508, FIG. 25) detent ball 608 will be dislodged from detent recess 610 thereby allowing link 600 to pivot with respect to link 602 providing a flexible configuration to bend into a position for extension up through the flow slots in the support plates of the interior of the steam generator. After the bend is made, the detent balls of one link again engage the detent recesses of an adjacent link to provide a rigid configuration for positioning and supporting inspection/cleaning devices up through the steam generator proximate the upper tube bundles.

The design shown in FIG. 32 offers advantages over the paired rigid chain design shown in FIG. 26 in that only one set of links is required and also offers advantages over the pin configuration shown in FIG. 30 since a pin engagement/retraction drive is not required. Also, in the configuration shown in FIG. 32, the hollow interior of links 600 and 602 provide a passage for the umbilical subsystem which provides cleaning fluid to the nozzles, power to the tools (welder, grippers, etc.) and video signals to and form the video camera.

Figure 33:
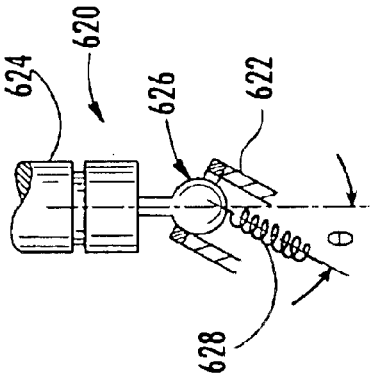
FIG. 33 is a schematic view of a spring biased rigid chain according to this invention.

In another embodiment, rigid chain 620, FIG. 33 includes links 622 and 624 joined by ball and spring assembly 626. Spring 628 biases link 624 to lock with respect to link 622 but upon the application of sufficient bending force (by pushing the chain through turn shoe 508, FIG. 25), the links rotate with respect to each other to make the 90° turn shown at 31, FIG. 1. The closest analogy to this embodiment is a series of tent poles engaged by an elastic "bungie" cord running through the center of the poles. After the 90° turn is made, the springs bias the links together providing a rigid configuration for deployment up through the steam generator.

Figure 35:
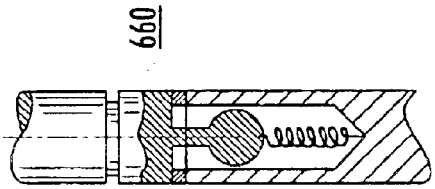
FIG. 35 is a schematic view of a rigid chain incorporating both a magnet and a spring.
Figure 34:
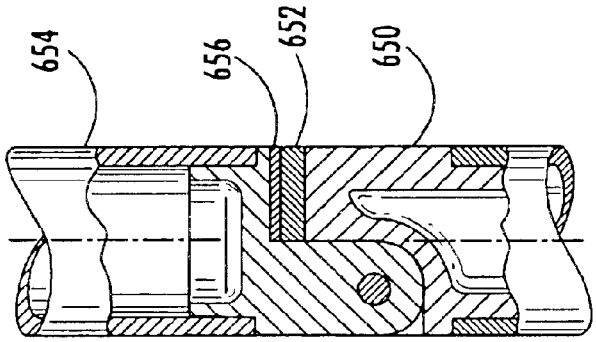
FIG. 34 is a schematic view of a magnetically biased rigid chain according to this invention.

In another embodiment, link 650, FIG. 34 includes rare earth magnet 650 while link 654 includes ferrous plate 656. The magnet 652 of link 650 is attracted to ferrous plate 656 of link 654 thereby urging the links to remain locked together. A sufficient bending force, however, as with the designs shown in FIGS. 32 and 33, will allow the links to rotate with respect to each other but will then engage after bending of the chain. Rigid chain 660, FIG. 35, is a combination of both the spring embodiments shown in FIG. 33 and the magnet embodiment shown in FIG. 34.

Figure 36:
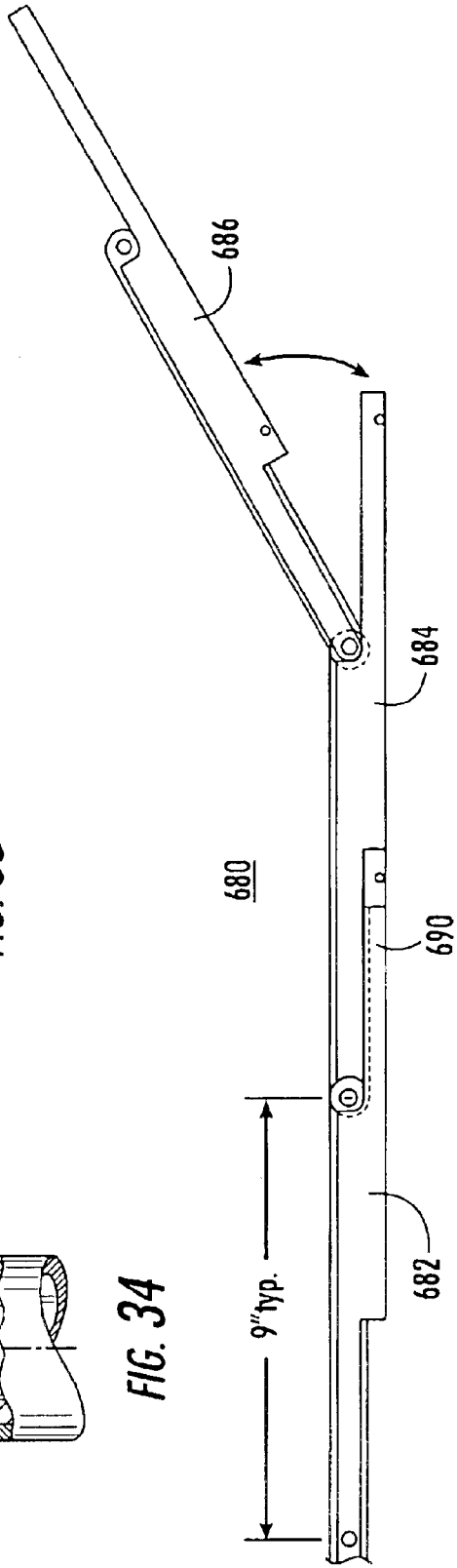
FIG. 36 is a front view of another type of rigid chain according to this invention.

In another embodiment, rigid chain 680, FIG. 36, includes fairly lengthy links 682, 684, and 686 each having an extension 690 as shown for link 682 which prevents each adjacent link from rotating in one direction. These longer links minimize the total number of links required for the system.

Rigid Links

Figures 37, 38:
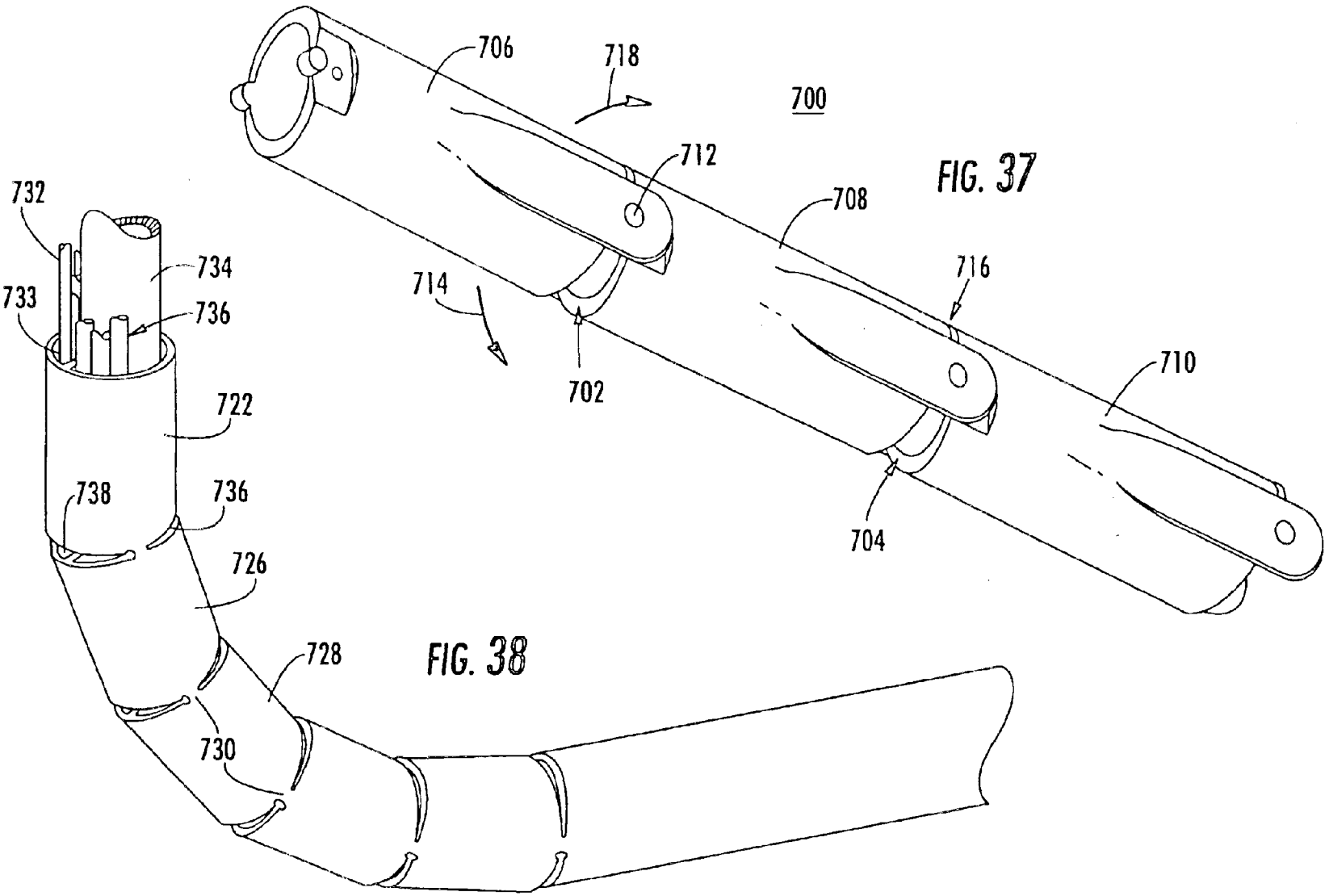
FIG. 37 is a schematic view of a series of rigid links with a single articulation recess according to this invention.
FIG. 38 is a schematic view of a series of rigid links having dual articulation recesses according to this invention.

Another embodiment for elongated body 480, FIG. 24 which is flexible in one configuration and rigid in another configuration is a series of rigid links, FIG. 37. Hollow rigid links 706, 708, 710 each include articulation recesses 703 and 704 between adjacent links 706, 708, and 710. In this embodiment, the articulation recess is only on one side of each link. Pivot pin 712 and articulation recess 702 allow link 706 to rotate slightly with respect to link 708 in the direction shown by arrow 714. Since each link can rotate slightly, the series of rigid links can make the bend required to traverse the blowdown lane of the steam generator (See FIG. 1) but then also extend upward through the flow slots and in this configuration the assembly is fairly rigid since "backbone" portion 716 prevents the individual links from bending in the direction shown by arrow 718.

A similar design is shown on FIG. 38 for rigid links 722, 726 and 728. In this case, each link 722, 724, and 726 comprises a hollow member joined to an adjacent link by elastomeric hinge element 730. Here, there is an articulation recess 736 and 738 on each side of each elastomeric hinge element. The series of links can bend enough to be driven down the blowdown lane and then turn upwards to extend up through the flow slots. Straightening cable 732 which passes through orifice 733 formed in each link is used to lock the links in a rigid configuration. Water umbilical 734 and peripheral service lines 736 pass through the center of each link. These links may be made of any flexible plastic material.

Mast Embodiments

An alternative to the various rigid chain or rigid link embodiments described above is shown in FIG. 40. Extendable mast 770 is made of a material normally self-biased to form a tube as shown at 762 even though it can be fed off a flat roll 764. The material of mast 760 is typically a 0.010 spring-tempered stainless steel available from Spar Aerospace 9445 Airport Road, Brampton, Ontario, Canada. The natural aspect of the material is a 2" diameter tube with plenty of overlap. The tube may be reinforced along its length by guide sleeves such as sleeve 764 as required.

Figure 40:
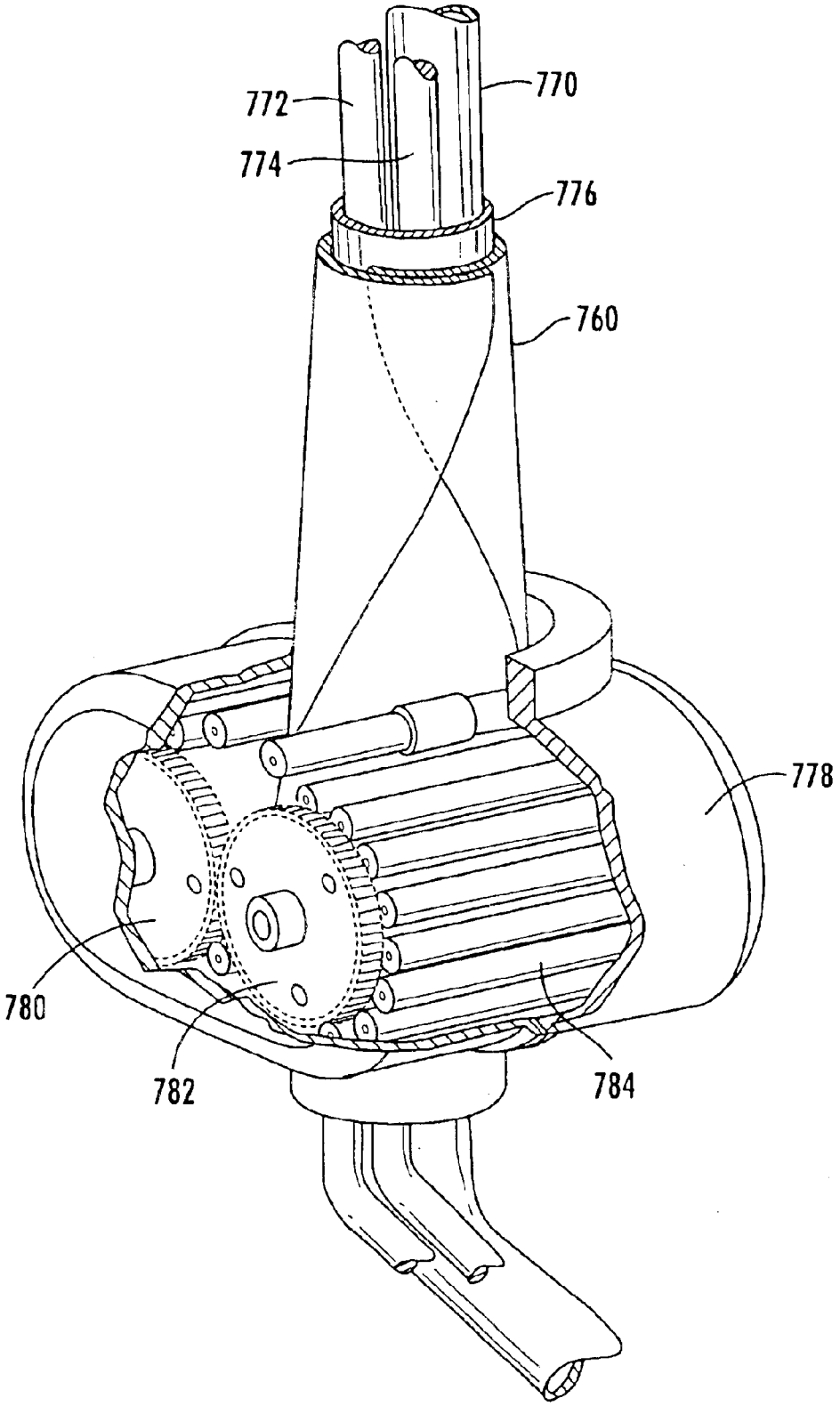
FIG. 40 is another view of the self-biased mast of this invention including drive means.

As shown in FIG. 40, mast 760 guides water line 770 and peripheral service lines 772 and 774 encased by jacketing material 776 up through the flow slots of the steam generator. Motor drive 778 drives this embodiment of the deployment system up through the flow slots. Motor drive 778 includes counter rotating drums 780 and 782 each driving planetary guide roller arrangement 784. As an alternative, two rolls of the mast material may be used to form a tube—each roll forming half of the tube with plenty of overlap for extra rigidity.

Combined Mast/Rigid Link Embodiments

Figure 41:
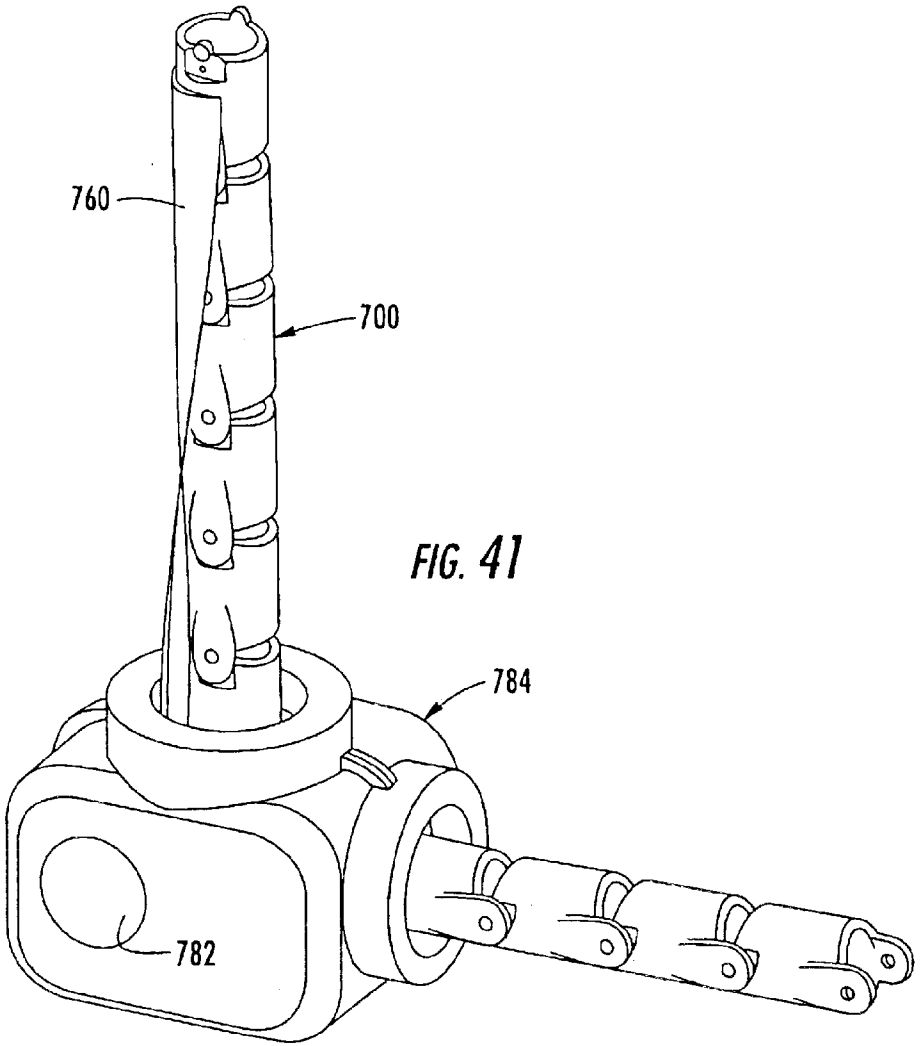
FIG. 41 is a schematic view of a deployment system according to this invention which employs both a mast material and a rigid link structure.
Figure 39:
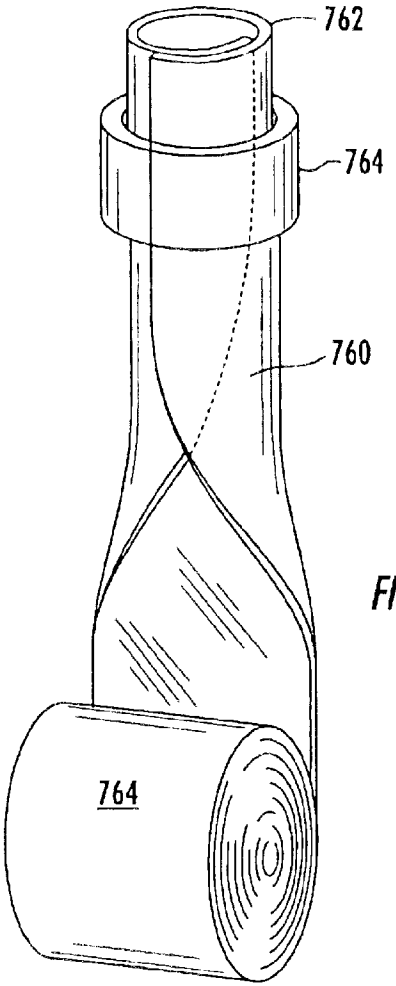
FIG. 39 is a schematic view of a self-biased mast used in the deployment system according to this invention.

The mast shown in FIG. 40 may be used in conjunction with any of the rigid chains or rigid links described above including the rigid link embodiment 700, FIG. 37 as shown in FIG. 41 for additional support as the rigid links are extended upward to the top of the steam generator. Mast storage drum 782, FIG. 41 includes the roll or rolls or mast material and turning shoe 784 feeds the rigid links from outside the hand hole of the steam generator and ultimately up through the flow slots in the successive series of support plates.

In any embodiment of the elongated snake-like body of this invention, whether rigid chain or rigid embodiments or the mast material embodiment, or combinations thereof, the boom and telescopic cylinders of the prior art shown in FIG. 2 are eliminated and instead the elongated body is small enough so that it can be fed through the hand hole of the steam generator and through the flow slots in successive support plates. The body is also fully retractable to prevent any risk of any component of the system from becoming lodged in the upper regions of the steam generator. The body is flexible enough in one configuration to bend into a position for extension up through the flow slots in successive support plates and rigid in another configuration for positioning and support cleaning head/inspection devices up about the upper tube bundles.

Accordingly, the instant invention in any embodiment achieves the seemingly mutually exclusive goal of providing a deployment device which can bend and which is also rigid enough after the bend to support a cleaning head or an inspection device at a distance up to 30 feet within the steam generator.

Although specific features of the invention are shown in some drawings and not others, this is for convenience only as some feature may be combined with any or all of the other features in accordance with the invention.

Other embodiments will occur to those skilled in the art and are within the following claims:

What is claimed is:

1. An upper bundle steam generator cleaning, inspection, and repair system comprising:

a deployment and support device receivable within the steam generator configured to raise and position a distal end of said device to the upper bundle region of the steam generator;

a head subsystem connected to the distal end of the deployment and support device for at least one of cleaning, inspection, and repair of said upper bundle region; and a lateral support subsystem deployable to support said head subsystem within the upper bundle region of the steam generator and retractable to deploy said head subsystem up to the upper bundle region and to withdraw said head subsystem therefrom.

2. The upper bundle steam generator cleaning, inspection, and repair system of claim 1 in which the lateral support subsystem includes fingers.

3. The upper bundle steam generator cleaning, inspection, and repair system of claim 2 in which said fingers are rotatable.

4. The upper bundle steam generator cleaning, inspection, and repair system of claim 3 in which said fingers are rigid.

5. The upper bundle steam generator cleaning, inspection, and repair system of claim 1 in which said head subsystem is a bulk cleaning head subsystem.

6. The upper bundle steam generator cleaning, inspection, and repair system of claim 5 in which said bulk cleaning head subsystem includes a camera.

7. The upper bundle steam generator cleaning, inspection, and repair system of claim 1 in which said head subsystem is a rigid lance cleaning head subsystem.

8. The upper bundle steam generator cleaning, inspection, and repair system of claim 7 in which said rigid lance cleaning head subsystem includes a camera.

9. The upper bundle steam generator cleaning, inspection, and repair system of claim 1 in which said head subsystem is an inspection subsystem.

10. The upper bundle steam generator cleaning, inspection, and repair system of claim 9 in which said inspection subsystem includes a camera.

11. An upper bundle steam generator cleaning, inspection, and repair system comprising:

a deployment and support device receivable within the steam generator configured to raise and position a distal end of said device about the upper bundle region of the steam generator, said upper bundle region including tube support plates having flow slots therein;

a head subsystem connected to the distal end of the deployment and support device for at least one of cleaning, inspection, and repair of said upper bundle region; and a lateral support subsystem for releasably supporting said head subsystem about said flow slots within said steam generator upper bundle region.

12. The upper bundle steam generator cleaning, inspection, and repair system of claim 11 in which the lateral support subsystem includes fingers.

13. The upper bundle steam generator cleaning, inspection, and repair system of claim 12 in which said fingers are rotatable.

14. The upper bundle steam generator cleaning, inspection, and repair system of claim 13 in which said fingers are rigid.

15. The upper bundle steam generator cleaning, inspection, and repair system of claim 11 in which said head subsystem is a bulk cleaning head subsystem.

16. The upper bundle steam generator cleaning, inspection, and repair system of claim 15 in which said bulk cleaning head subsystem includes a camera.

17. The upper bundle steam generator cleaning, inspection, and repair system of claim 11 in which said head subsystem is a rigid lance cleaning head subsystem.

18. The upper bundle steam generator cleaning, inspection, and repair system of claim 17 in which said lance cleaning head subsystem includes a camera.

19. An upper bundle steam generator cleaning, inspection, and repair system comprising:

a deployment and support device receivable within the steam generator configured to raise and position a distal end of said device to the upper bundle region of the steam generator, said upper bundle region including tube support plates having flow slots therein;

a head subsystem connected to the distal end of the deployment and support device for at least one of cleaning, inspection, and repair of said upper bundle region; and a lateral support subsystem for releasably supporting said head subsystem about the tubes of the upper bundles of the steam generator during at least one of said cleaning, inspection and repair.

20. An upper bundle steam generator cleaning, inspection, and repair system comprising:

a deployment and support device receivable within the steam generator configured to raise and position a distal end of said device to the upper bundle region of the steam generator;

a head subsystem connected to the distal end of the deployment and support device for at least one of cleaning, inspection, and repair of said upper bundle region; and a lateral support subsystem for registering said head subsystem within the upper bundle region of the steam generator during at least one of said cleaning, inspection and repair.

21. An upper bundle steam generator cleaning, inspection, and repair system comprising:

a deployment and support device receivable within the steam generator configured to raise and position a head subsystem within the upper bundle region of the steam generator, and a lateral support subsystem connected to a distal end of the deployment and support device to support said head subsystem and for providing mechanical engagement with and disengagement from a tube support plate within the steam generator.

22. The upper bundle steam generator cleaning, inspection, and repair system of claim 21 in which said head subsystem is a bulk cleaning head subsystem.

23. The upper bundle steam generator cleaning, inspection, and repair system of claim 21 in which said head subsystem is rigid lance cleaning head subsystem.

24. The upper bundle steam generator cleaning, inspection, and repair system of claim 21 in which said head subsystem is an inspection subsystem.

25. An upper bundle steam generator cleaning, inspection, and repair system comprising:

a deployment and support device receivable within the steam generator configured to raise and position a distal end of said device to the upper bundle region of the steam generator;

a head subsystem connected to the distal end of the deployment and support device for at least one of cleaning, inspection, and repair of said upper bundle region; and a lateral support subsystem for releasably supporting said head subsystem within said generator upper bundle region.

26. An upper bundle steam generator cleaning, inspection, and repair system comprising:

a deployment and support device receivable within the steam generator configured to raise and position a distal end of said device to the upper bundle region of the steam generator;

a rotatable mechanism attached to the distal end of said device;

an arm attached on a first end to said rotatable mechanism and rotatable horizontally and vertically by the rotatable mechanism;

at least one of a cleaning device, an inspection device and a tool on a second end of said arm; and a lateral support subsystem connected to said arm and deployable to support said at least one of a cleaning device, an inspection device, and a tool, said lateral support subsystem providing mechanical engagement with and disengagement from a tube support plate within the steam generator.

* * * * *